United States Patent [19]

Morton

[11] 4,265,599

[45] May 5, 1981

[54] HYDROPNEUMATIC ENERGY SYSTEM

[76] Inventor: Paul H. Morton, 180 Berkeley St., Satellite Beach, Fla. 32937

[21] Appl. No.: 7,913

[22] Filed: Jan. 31, 1979

[51] Int. Cl.[3] ..... F04F 1/08

[52] U.S. Cl. ..... 417/54; 417/101; 417/131; 417/138; 417/150; 417/337

[58] Field of Search ..... 417/53, 54, 150, 100, 417/101, 92, 138, 131, 126, 130, 225, 337; 60/496, 495

[56] References Cited

U.S. PATENT DOCUMENTS

| | | | |
|---|---|---|---|
| 1,091,313 | 3/1914 | Erickson | 417/101 |
| 1,550,408 | 8/1925 | Witt | 60/496 |
| 2,626,740 | 1/1953 | Levy | 417/101 |
| 3,485,038 | 12/1969 | Martin et al. | 417/337 X |
| 4,083,661 | 4/1978 | McPherson et al. | 417/131 |

*Primary Examiner*—Carlton R. Croyle
*Assistant Examiner*—Edward Look
*Attorney, Agent, or Firm*—Harold Gell

[57] ABSTRACT

A system for converting a constant pressure head of water into compressed air which may be utilized to transfer the potential energy of the pressure head to remote work sites.

11 Claims, 4 Drawing Figures

248
249
250
251
246
247
253
256
244
243
239
240
238
241
252
235
237
236
235
234
233
254
255
291
292
293
228
227
231
257
221
229
232
258
259
290
223
218
245
224
225
226
226
217
230
202
203
204
205
208
209
211
216
201
200
207
206
210
212
215
260
213
214
261
295
296
297
262
263
264
266
265
275
274
277
278
280
279
276
281
282
288
284
283
299
267
268
269
270
271
272
273
287
286
285
289
298
401

HYDROPNEUMATIC ENERGY SYSTEM

THE INVENTION

This invention relates to a means to convert the potential energy of a constant, steady pressure head of liquid such as water into compressed air which may be directed to remote sites to perform work.

BACKGROUND OF THE INVENTION

Contemporary civilization is placing increasing demands on all forms of energy resources and the alarming depletion rate of non-renewable energy sources such as petroleum has placed an increasing demand on development of the relatively inexhaustible energy sources.

One relatively inexhaustible source of energy which has been utilized for ages but has received little interest by those striving to develope new sources of energy is the water pressure head. This source of energy has been used to drive water wheels for generations and the water wheels have been used to grind grain in their crudest form or generate electricity in the more refined turbine. However, the only common, modern use of a water pressure head is in hydroelectric power systems. These systems use enormous quantities of water and provide no useable means to store commercial quantities of the energy produced.

Another means for extracting energy from a hydraulic head which has greater storage potential than the electrohydraulic systems is the conversion of the potential energy into a compressed gas which may be transported over relatively long distances via pipe lines and stored in natural or artificially created subterranean chambers. A few attempts have been made in the past to convert a hydraulic head into compressed gas but these attempts have met with little commercial success for a variety of reasons generally relating to their inability to economically produce a constant commercial volume.

Research has revealed that water from a non-surging head has been used to compress air in commercial quantities. In fact, an Italian engineer, Germain Sommeiller, used a modification of the hydraulic ram to compress air for penumatic drills used in the construction of the Mont Cenis tunnel. This tunnel was built under the Alps (1857–71) and linked the railways of France and Italy. The operation of these devices required huge quantities of water, and the fact that they are no longer in common use as compressors is probably due to their low efficiencies and limited application. The hydraulic ram is still in limited use for lifting water, but its inherent inefficiency and limited application has prevented it from making a substantial contribution. The hydraulic ram is primarily a kinetic energy conversion device. Water from an elevated source is directed through the device until a high velocity flow is attained. By means of a quick-acting valve, the high velocity water exiting the device is stopped. The resultant kinetic kick is utilized to compress air trapped above a water piston, and the greatly intensified compressed air is utilized to drive a small quantity of water to a location much higher than the original source feeding the ram. The design intent of this invention was to overcome the severe inefficiencies and very limited applications of the hydraulic ram. Because of the kinetic shock stresses produced in the hydraulic ram, the construction materials required for even the smallest ram can be very expensive. The intent of the invention hereinafter described is to provide a different approach to the extraction of potential energy from a non-surging head of water, and to make this extraction with much higher efficiencies. A second, and equally important, intent of this invention is to capture economically the energy of water heads with very limited flow volumes.

Some of the early types of utilizing naturally occurring hydraulic heads to compress air relied upon wave and tide motion.

An early example of the use of wave energy to create compressed air is illustrated in U.S. Pat. No. 655,541 issued to A. M. Becker on "Marine Air Power Apparatus" Aug. 7, 1900. In this device, waves rise in chambers having one-way exhaust valves through which air trapped by the wave is forced as the water fills the chamber. A more contemporary example of a similar apparatus is illustrated in U.S. Pat. No. 3,149,776 issued to W. C. Parrish on "Air Compressors Utilizing The Kinetic And Potential Energy Of Water Waves Common To Bodies Of Water" issued Sept. 22, 1964. In this device a deflector or obstructing means causes the waves to build up so that the kinetic energy is converted to potential energy in the form of an increased hydraulic head which forces water into a plurality of tubes containing air which is driven out through one-way valves.

Other examples of pneumatic attempts to harness the hydraulic head created by waves are illustrated in U.S. Pat. No. 567,920 issued to R. Toennes on "Air Compressor" on Feb. 9, 1897; U.S. Pat. No. 960,478 issued to D. R. Allard on "Air Compressor" issued June 7, 1910; U.S. Pat. No. 1,005,911 issued to F. P. Wilbur on "Hydraulic Power Air Compressor" issued Oct. 17, 1911; and U.S. Pat. No. 4,022,549 on "Shore Line Air Compressors Wherein Swell Water Pumps The Air" issued May 10, 1977. All of the foregoing devices are subject to the irregular nature of waves in large bodies of water. Waves of the magnitude required to create compressed air at a commercially acceptable rate are large waves of the kind normally associated with storms and high winds over long reaches of the body of water concerned. These severe environmental situations are not normal and therefore, the operation of compressed air plants relying on wave action is unreliable. Long periods where the body of water is calm due to an absence of storms result in the commercial failure of such systems due to their lack of reliability and lack of a storage system for the compressed air which has a capacity to provide a supply during calm periods.

Other attempts to utilize moving bodies of water to compress air in a more reliable manner rely on tide action. P. H. Montague in U.S. Pat. No. 631,994 on "Air Compressor" issued Aug. 29, 1899 and W. M. Marsden, U.S. Pat. No. 1,036,502 on "System Of Developing Natural Power For Industrial Purposes" issued Aug. 20, 1912 are examples of such devices. Systems such as these failed to meet with commercial success because of the very limited quantity of compressed gas they could produce.

J. O. Boving, U.S. Pat. No. 1,628,025 on "Hydraulic Air Compression Plant" issued May 10, 1927 provides compressed air by relying on any source of moving water which may be caused to flow down a tube. Systems such as Boving utilize a venturi effect to compress the gas and therefore expend large volumes of fluid for a relatively small amount of compressed gas, a feature which apparently renders them commercially unsuccessful.

W. S. Bryant in U.S. Pat. No. 643,863 on "Floating Pump" issued Feb. 20, 1900 disclosed a special case of a pump functioning on wave or tide action in that the compression chambers float upon the body of water creating the required pressure heads. This device suffers from the same shortcomings as previously discussed with respect to wave action and tidal action air compressors.

OBJECTIVES OF THE INVENTION

In view of the obvious inability of the prior art systems to provide a commercially feasible means to convert hydrostatic pressure into compressed gas in commercially useable volumes, it is a primary objective of the present invention to provide a means whereby the energy of a hydrostatic head may be converted to a relatively large volume of compressed air.

Another objective of this invention is to provide an economical method of extracting the potential energy from the many thousands of unused non-surging water heads that exist throughout the world. The premise of this invention has its basis in Boyle's Law, and pre-concludes that work must be done and energy must be transferred when the internal volume of a gas confined to a closed container is changed.

A third and almost equally important objective is to effectively extract the potential energy of the many thousands of small water drops that occur in nature throughout the world without the use of dams.

It is a further objective of the present invention to provide an air compressor which utilizes a static head of water as a power source.

It is a still further objective of the present invention to provide a hydrostatic air compressor incorporating a positive displacement pump chamber using liquid under pressure as a gas compression piston in combination with means to drain the compressive liquid from the chamber and admit air at ambient pressures while the hydrostatic source which created the preceding compression cycle remains available to energize a following cycle.

A further objective of the present invention is to provide a pump type air compressor driven by hydrostatic pressure provided by an artisan well.

A still further objective of the present invention is to provide a pump type air compressor driven by a hydrostatic pressure source created by a body of water which could take the form of a small man made pond at an elevated location that would be replenished with rain.

A further objective of the present invention is to provide an energy transfer system for extracting energy from a hydrostatic source in the form of compressed air and utilizing the compressed air to create a driving force for a piston.

A still further objective of the present invention is to provide a system for transferring the potential energy of a hydrostatic pressure head via compressed gas to a remote site and converting the potential energy into actual energy for accomplishing work.

A further objective of the present invention is to automatically stop energy flow from a limited static head (volume wise) when the energy is not needed.

A still further objective of the present invention is to utilize a non-surging water head as the energy source to power a hydraulic air compressor, wherein any suitable container, having been pre-charged with air at atmospheric pressure is automatically connected to the water head and allowed to fill with water from said water head; compressed air created by the filling process to be utilized in performing useful work.

A further objective of the present invention is to provide a sensing device with appropriate automatically operated "fill", "drain", and "vent" valves which will initiate a drain cycle with each complete filling of the compressor.

Another objective of the present invention is to provide automatic sequential control of the above processes so that in effect a relatively slow-moving reciprocating water piston is created within the compressor chamber.

A still further objective of the present invention is to design said control apparatus so that hydraulic shock is not produced within the compressor or connecting conduits when the above-listed events occur.

A further objective of the present invention is to design the aforementioned hydraulic air compressor so that all power requirements needed for the fully automatic operation of said air compressor are fulfilled within the apparatus itself.

Another objective of the present invention is to design the aforementioned air compressor so that no energy flows from the water head when compressed air requirements from the compressor have been met.

A still further objective of the present invention is to utilize a compressed gas (usually air) to move a liquid from a container, in much the same fashion that liquid is moved from the common garden sprayer; the liquid so moved (by said blow pump) to be lifted to a higher elevation and stored in a suitable reservoir.

Another objective of the present invention is to design said blow pump so that it will automatically vent and refill from the liquid free source, at any time the liquid level within the blow pump chamber reaches a pre-determined low level.

It is a still further objective of the present invention to design said blow pump chamber so that it can be replenished with liquid by being submerged within the liquid being pumped or supplied with liquid by means of any suitable conduit from a liquid at a slightly elevated source.

A further objective of the present invention is to design said blow pump control devices so that any termination of the compressed air supply feeding the blow pump chamber causes the blow pump chamber to automatically vent and refill with liquid from the liquid free source; this action to occur regardless of the liquid level within the blow pump chamber whenever said termination occurs.

A still further objective of the present invention is to design said blow pump control devices so that any number of blow pumps can be supplied with compressed gas from a common supply line; the maximum hydraulic lift of any individual blow pump on the common supply line to be determined solely by the compressed gas pressure available.

Another objective of the present invention is to design said blow pump control devices so that priority can be assigned to individual blow pumps regardless of their respective hydraulic lifts; i.e., pumps with greater hydraulic lifts can be given a higher priority than pumps with lesser hydraulic lifts, and compressed gas from the common supply line would not be directed into the low lift pumps until the lifting requirements for the high lift pumps have been met.

A further objective of the present invention is to design the blow pump control devices so that compressed gas supplied to the blow pump is automatically shut off when lifting requirements have been satisfied; this feature to insure that no energy flows from the source on "off" cycles.

A still further objective of the present invention is to design the control devices of the blow pump so that the only source of energy required for fully automatic operation of the blow pump is any compressed gas.

Another objective of the present invention is to convert the energy of a high-volume, low-pressure, compressed gas source into a buoyant force, and to utilize this buoyant force to obtain an energy intensification; the higher energy level obtained from this intensification process to be utilized in the performance of useful work.

It is a still further objective of the present invention to utilize the high-volume, low-pressure compressed air source as the only source of power needed for fully automatic operation of the inverted bucket pump.

A further objective of the present invention is to design the automatic control system so that it will readily adapt to a very large or extremely small inverted bucket pump assembly.

Another objective of the present invention is to design the automatic control system so that it will readily adapt to an inverted bucket pump making a hydraulic lift or an inverted bucket pump being utilized as a gas compressor.

A still further objective of the present invention is to design the automatic control system so that it will readily adapt to inverted bucket pumps with long pumping strokes (i.e., 20 ft. or more), or short pumping strokes (i.e., 10 inches or less).

SUMMARY OF THE INVENTION

The total invention herein described is constructed around the laws formulated by Robert Boyle, a British physicist and chemist (1627–91). Briefly stated, his law holds that the volume of a gas within a closed container is inversely proportioned to the pressure, providing the temperature remains constant. For the purpose of this discussion, the temperatures are of little consequence and, for the sake of simplicity, are assumed to remain constant.

Because of the inexpensive, but rather complex, nature of the controls required to make the invention operate automatically, no attempt will be made at this time to explain the workings of these devices. The emphasis at this point will be placed on the basic physics involved in the energy transfer. The three major components of this invention are all designed to operate independently of each other but, in the configuration shown, the components are being utilized to extract energy from a non-surging water head, and utilize this energy to elevate a percentage of the water from the source to a much higher level.

The drawing in FIG. 1 illustrates graphically the three basic components of the invention. For the sake of simplicity, a walk-through explanation of the components and a manual operation of all components will be presented. The hydraulic air compressor is a chamber located at a point which will take advantage of the maximum water head available. In the illustration (FIG. 1), the uppermost part of the hydraulic air compressor is located at a position 231 feet below the water head feeding it. The bottom of the pneumatic blow pump (so-called because of the lack of a better name) is located eight feet below the source water, or 223 feet above the compressor chamber. To simplify the explanation of the devices, it is assumed that a previous operator has just left the pumping apparatus, and the following conditions exist. The hydraulic air compressor is full of water, the blow pump chamber is full of water. The blow pump storage tanks and the bucket pump storage tank are each approximately half-full of water. The inverted bucket float is in the "down" position, as shown in the drawing. All hand valves in the system, with the exception of Valve #5, are shut. Valve #5 has been left open by the previous operator. A complete cycle of the apparatus has just been completed, and the preparations have been made for a second cycle.

The first task in starting the second cycle is to drain all water from the compressor chamber and bring in a fresh charge of atmospheric air. This is accomplished by opening the compressor drain Valve #4 and opening the compressor vent Valve #3. As water is leaving the compressor chamber through the open drain Valve #4, a fresh charge of air at atmospheric pressure is being brought into the chamber through the open vent Valve #3. Valves #3 and #4 are shut when the water stops flowing from the chamber.

To start the compression cycle, the compressor fill Valve #2 is opened. Water from the source begins rushing into the chamber. The air trapped in the chamber above the incoming water will be displaced by the incoming water. A pressure gage located just below the air shut-off Valve #1 indicates the pressure of this compressed air. The gage will show a rapid rate of pressure increase when Valve #2 is opened, but as the air pressure trapped above the incoming water approaches a point equal to the pressure of the water head, the rate of pressure increase will diminish. When the pressure gage reaches a pressure of 100 pounds ($0.434 \times 231$), the flow ow water into the compressor will stop.

The pressure gage reading that we have just observed at 100 pounds indicates that the compressor chamber now contains a fresh charge of compressed atmospheric air. For the purpose of this discussion, it is assumed that the internal volume of the compressor chamber is 100 cubic feet. Knowing that the new pressure is 100 pounds gage and that the compressor chamber contained 100 cubic feet of air at atmospheric pressure when we opened the inlet water valve, we can use Boyle's Law to find just how much compressed air and how much water is now in the compressor chamber.

$Po \times Vo = Pn \times Vn$ $Po = 15$ pounds (old absolute pressure)

$Vo = 100$ cubic feet (old volume)

$Pn = 100 + 15 = 115$ (new absolute pressure)

$Vn =$ unknown $15 \times 100 = 115 \times Vn$ $Vn = 1500/115$ $Vn = 13.04$ cubic feet, meaning the compressor contains 13 cubic feet of air at 100 pounds gage pressure, and 87 cubic feet of water.

The blow pump chamber contains 40 cubic feet of water, and its bottom is located 8 feet below the source water. A pressure gage (not shown) installed at the top of the blow pump chamber reads approximately 3 pounds, because of the source water head impressed on the blow pump chamber. Our next objective is to reverse the original compression process, and utilize the compressed air in the compressor to blow water from the blow pump chamber to the blow pump storage tank.

Air shut-off Valve #1 is opened. Compressed air will start flowing into the top of the blow pump chamber, forcing the water in the chamber down, then upward through the vertical discharge line, which terminates at the top of the blow pump storate tank. This flow occurs because the total opposing pressure is less than the 100 pounds gage pressure now available at the top of the blow pump chamber. The opposing pressure results from the head created by the 200 ft. vertical lift. We have previously determined that the water head feeding the compressor is 231 feet, so we have a pressure differential of 31 feet or 31×0.434 or 13 pounds.

When the air shut-off Valve #1 is opened, compressed air starts leaving the compressor and water again starts flowing into the compressor chamber from the source to replace this displaced compressed air. A sight glass located at the top of the compressor chamber signals us to shut the compressor fill Valve #2 when the compressor fills with water. We now have a new condition: the compressor chamber is full of water, but the blow pump chamber contains compressed air and water. If we know that the prssure at the top of the blow pump chamber was three lbs. gage when we started to blow, our new pressure at the top of the blow pump chamber will be 200×0.434, plus some value slightly less than the three lbs. gage pressure with which we started. If we assume this new pressure to be 87 pounds gage, we can again use Boyle's Law to calculate how much water we have blown from the blow pump chamber to the blow pump storage tank.

$Po \times Vo = Pn \times Vn$ $Po = 115$ pounds (old absolute pressure)

$Vo = 13$ cu.ft. (vol. of compressed air displaced from compressor by incoming water)

$Pn = 87 + 15 = 102$ (new absolute pressure in blow pump chamber)

$Vn$ = unknown volume of air now in top of blow pump chamber $115 \times 13 = 102 \times Vn$ $Vn = 1495/102$ $Vn = 14.65$ cubic feet of air at 87 poungs gage pressure The fact that 14.65 cu. ft. of compressed air at 87 pounds pressure is now in the blow pump chamber means that 14.65 cu. ft. of water has been displaced from the blow pump chamber, and elevated 200 ft. to the blow pump storage tank. Converting cubic feet to gallons (1 cu. ft. equals 7.48 gals.), the 14.65 cu. ft. of water equals 109.5 gallons of water lifted. Since the blow pump chamber top is located 5 ft. below the source water, the total net lift was 195 ft. The total amount of water used from the source to effect this left was the sum of the water lifted and the water required to fill the compressor. Knowing that 100 cu. ft. of water flowed into the compressor chamber, the conversion shows 100 cu. ft.×7.48 gal. or 748 gallons flowed to the compressor chamber. This 748 gallons added to the 109.5 gallons that were displaced from the pump chamber equals 857.5 gallons, the total amount of water used from the source.

To emphasize a few important points and to make a closer examination of the previously described events, a discussion of the inverted bucket float pump and how it is utilized will be postponed. The driving force for this float pump is in the 14.65 cu. ft. air bubble now trapped in the blow pump chamber. We are not concerned with this energy at the present time because the present discussion will be confined to the compressor and blow pump. By opening a valve (not shown), in the blow pump vent line, this vent air can be released directly to the atmosphere and the blow pump chamber will again refill by gravity with water from the source. A refilling of the blow pump chamber will place us back at our starting point in the cycle. To conserve the compressed air in the air line connecting the compressor to the blow pump, Valve #5 should have been shut when the blow pump chamber was vented and re-opened when the vent was shut.

We have completed one cycle of operation, utilizing the compressor and blow pump in combination. We will now examine the efficiency of this lift. In the English system, the unit of work is the foot pound. The water flow into the compressor was 748 gallons. In converting gallons to pounds (748 gals.×8.3296 pounds), we had 6230.5 pounds falling through 231 ft. (231×6320.5) or an input of 1,439,245 foot pounds of work. The water lifted was 109.5 gallons. In converting to pounds (109.5 gals.×8.3296 pounds), we have 912 pounds lifting a net distance of 195 ft. (912×195) or an output of 177,840 foot pounds of work.

$$\% \text{ efficiency} = \frac{\text{Output}}{\text{Input}} \times 100$$

$$\% \text{ efficiency} = \frac{177{,}840}{1{,}439{,}245} \times 100 = 12.35\%$$

On the surface, this 12.35% efficiency figure is not very impressive, but let us re-examine the cycle we have just completed and consider the source water to be a small spring in a comparatively inaccessible gorge. In many applications, the ability to left water this 195 ft. would be very useful. The flow rate from the spring does not have to be large. In this cycle just completed, it took a total of 857 gallons to lift 109 gallons. Even if the flow rate limited us to one cycle per hour (857 gals.÷60 min.=14.2 gallons per minute), we could still lift in 24 hours a total of 2,616 gallons, which calculates to a monthly lift rate in excess of 78,000 gallons.

THE INVERTED BUCKET PUMP

An examination of the processes just described reveals that the work done in lifting the source water was accomplished strictly from the expansion of the air bubble we created in the compressor chamber. When we vented this air bubble to the atmosphere to allow refilling of the blow pump chamber in preparation for the second cycle, the potential work that could be obtained from further expansion of this vent air was lost. The function of the inverted bucket pump is to allow further expansion of the bubble and to extract as much work as possible from it before it is finally released to the atmosphere. One logical way to do this is to convert the expansive work potential to a buoyant force, and to obtain an energy intensification or concentration from this expansion. The inverted bucket pump accomplishes this conversion for a second stage lift.

To visualize how this pump works, imagine an old-fashioned washtub placed upside down on the surface of a swimming pool. The tub will not sink since there will be a bubble of air trapped within the inverted tub. If an extended pipe and valve were attached by a flange to the flat surface of the tub prior to our placing it in the pool, we could open the vent valve and release the trapped air, causing the tub to sink. Because our next objective is to make the tub buoyant with as little pressure as possible, we will limit the distance the tub sinks in the pool to 18 inches below the surface, and fasten the tub by some means in this position. With the tub submerged to the 18" level, the vent valve is closed. Because the top surface of the now-submerged tub is only 18" below the surface of the pool water, the air pressure required to blow the water from the tub is 18" plus the head created by the tub sides. If we assume the tub sides are 12", the total water head to overcome is 18"+12", or 2.5 ft. Multiplying 2.5 by 0.434 gives us 1.085 pounds gage pressure. This low pressure is close enough to atmospheric pressure to allow the use of lung power to blow the water from the tub. If we now enlist the aid of some neighborhood children and provide them with a hose and a one-way check valve, all the water can be blown from the tub. The end of the hose with the check valve is placed under the tub edge and blowing is commenced on the other end. When the first air bubble is observed rising from the bottom edge of the tub, it signals us that all the water has been blown from the tub and maximum buoyancy of the tub now exists. Any further blowing would be a waste. If the tub had a water holding capacity of 30 gallons, the buoyant lifting force of the tub is now 30 gallons multiplied by 8.3296 pounds per gal. or 250 pounds. This 250 pounds of lifting force is the net result of our energy concentration or intensification. This is the force that is utilized to drive a piston for a second stage lift. The stroke limitation of 18 inches was used to illustrate the extremely low air pressures that can be converted to practical work if the volume is great enough. For example, a large shallow float bucket could be directly driven from a high volume compressor chamber operating from a fall of 3 ft. or less; or, a windmill driving a high volume low pressure air compressor could also provide the air necessary to blow the water from a shallow bucket.

Now that the operating principle of the second stage lift has been presented, we can go back through a second cycle of the compressor and blow pump. This time we will utilize the air vented from the blow pump to cycle the inverted bucket pump. For the purpose of this discussion, the inverted bucket is held at the same size as the previously discussed tub. The bucket sides are 12" and the internal volume is 4 cubic feet. The lifting force of the blown bucket is the weight of 4 cubic feet of water or 249 pounds. The inverted bucket floats within a tank 6 feet tall and has a stroke of 5 feet. Attached to the top of the inverted bucket is a rod connected to a conventional piston-type pump. The whole assembly is placed slightly below the blow pump storage tank and the water supply to the piston pump is gravity-fed from this tank. The liquid in the tank housing the float bucket is also supplied from the blow pump storage tank and is held at a constant minimum level by a conventional float valve. The float valve closes when this tank is initially filled with water and only opens to replace water lost by evaporation. FIG. 1 shows proper water level, bucket vented and down.

The drawing in FIG. 1 shows the bucket at the bottom of the tank housing it and, as illustrated, it is full of water. The piston of the pump is 2" in diameter and the total displacement of this conventional piston pump is $Pi \times r^2 \times h$ or $3.14 \times 60''$ or 188 cubic inches. The net lifting force of the bucket when blown is 249 pounds, less the weight of the bucket and connected pump. External flotation attached to the exterior of the bucket limits this negative weight to 10 pounds, so our total net lifting force is 239 pounds. This lifting force applied to a piston 2" in diameter gives $Pi \times r^2$ or $3.14 \times 1^2$ or 3.14 sq. inches of piston area. Dividing the 239 pounds by 3.14 sq. in., we get 76 pounds per square inch of pressure for our second stage lift. The 76 pounds converted to a water head (76 pounds×2.304 ft. of water head) equals 175 feet. The top of the bucket pump storage tank is located at this higher elevation, making a combined net lift from the source of: 195 ft. (the first lift), plus 175 ft. (the second lift), minus 10 ft. (the blow pump storage tank height), or a net lift from the source of 360 ft.

PLACING THE INVERTED BUCKET PUMP IN OPERATION

It is assumed that the second cycle of the compressor chamber and blow pump chamber combination has been completed. We are ready to vent the 14.65 cubic feet of air at 87 pounds gage pressure to the inverted bucket pump. Because we are operating the system manually, an assistant is needed at this point. The assistant will observe the inverted bucket and operate the vent valve attached by pipe to the top of the bucket. When the assistant is on location above the inverted bucket pump assembly, the blow pump vent valve #6 is opened. The assistant signals us when the first air bubble rises through the water in the tank housing the inverted bucket. We quickly close Valve #6 since the bucket now has maximum positive buoyancy and any additional blowing would waste our stored energy. The assistant opens the inverted bucket vent valve when the bucket reaches the top of its 5 ft. stroke. This causes the bucket to sink for the second blow and the bucket vent is closed when the bucket attains its original downward position. These steps are repeated until we no longer have vent air pressure to blow water from the inverted bucket.

How many times can we lift the inverted bucket pump, using just one cycle of the air compressor and blow pump combination? We have previously calculated the vent air volume and pressure, and can use Boyle's Law to answer this question. The air bubble trapped in the blow pump chamber when the compressor chamber became full of water was calculated at 14.65 cu. ft. with a pressure of 87 pounds gage. The air required to blow all the water from the inverted bucket for one cycle of the inverted bucket pump is now calculated. We know the internal volume of the bucket is 4 cubic feet. We also know that the head of water that must be overcome to blow the bucket is the 5 ft. of water above the bucket plus the head created by the bucket sides or a total of 6 ft. The final pressure and volume in a blown bucket is $6 \times 0.434 + 15$, or 17.6 pounds pressure absolute, and 4 cubic feet. Using Boyle's Law to reduce the pressure and increase the volume of the vent air trapped in the blow pump chamber results in the following equation:

$Po \times V0 + Pn \times Vn$ $Po = 87 + 15$ or 102 pounds (old absolute pressure)

$Vo = 14.65$ cubic feet $Pn = 17.6$ pounds absolute $Vn =$ unknown $102 \times 14.65 = 17.6 \times Vn$ $Vn = 1494/17.6$ $Vn = 84$ cubic feet The resultant 84 cubic feet of vent air at the required pressure means that 84 divided by the 4 cubic feet needed per cycle provides 21 blowings of the inverted bucket with each cycle of the compressor and blow pump combination.

If we do not waste this now expanded 84 cubic feet of air at 17.6 pounds absolute, we make a new calculation of our efficiency.

Our first calculation of efficiency revealed that we extracted 177,840 foot pounds of work from a work input of 1,439,245 foot pounds, for an efficiency rate of 12.35%. If we add the foot pounds of work accomplished by the inverted bucket pump to the work extracted in the first lift, we obtain a new higher efficiency. The inverted bucket pump lifts a net distance of 360 ft. minus 195 ft., or 165 ft. Each stroke of the inverted bucket moves 188 cubic inches of water to the inverted bucket pump storage tank. By multiplying 188 cu. in. by the 21 lifts obtained above, we find 3,948 cubic inches of water lifted. Converting that to gallons or dividing the 3,948 by 231 equal 17 gallons. Converting the gallons to pounds or 17 multiplied by 8.32 equals 141 pounds. Converting that to foot pounds or 141 multiplied by 165 equals 23,265 foot pounds of work accomplished by the second stage lift. Adding this work to the previous extraction (177,840+23.265), we now have 201,105 foot pounds of work extracted. To recalculate the efficiency, we divide 201,105 by 1,439,245 and multiply the result by 100 and learn that we now have 13.97 or 14% (new efficiency).

THE BALANCE CHAMBER

The balance chamber is an air storage tank that is put into the system or taken out of the system by the opening or closing of Valve #8 in FIG. 1. The balance chamber is located higher than the source water so that no water from the source can enter it. It must also be located below or in the line ahead of the blow pump vent valve. When the balance chamber valve is opened, the amount of water lifted from the blow pump chamber is reduced, but the amount of water lifted from the inverted bucket pump is increased. The purpose of the balance chamber is to allow a higher percentage of the total water lifted to be delivered to the bucket pump storage tank. Valve #8 would normally be opened automatically by a sensing means installed in the blow pump storage tank. This sensor would open the balance chamber valve when the water in the blow pump storage tank reaches a predetermined high level. As we are operating the system manually, we will assume that water usage from the blow pump storage tank has been small and we wish to divert most of the compressed air to the inverted bucket pump.

A review of our previous manually-controlled cycles revealed the following facts:

(1) With each cycle of the compressor and blow pump combination, a total of 109.5 gallons of water was lifted.

(2) Of this 109.5 gallons, 17 gallons was lifted to the higher inverted bucket pump storage tank.

(3) By opening the balance chamber Valve #8, we can change this ratio and have more water delivered to the bucket pump storage tank and less water delivered to the blow pump storage tank.

We will assign a holding capacity of 7 cubic feet to the balance chamber, and open Valve #8 to place it in the system. A cycle of the compressor is completed with the 7 cu. ft. balance chamber in the system. At the end of the compressor-filling cycle, we have a new condition in the blow pump chamber. In our previous cycles, the blow pump chamber contained 14.65 cubic feet of air at 87 pounds gage pressure. In the new cycle with the balance chamber in the system, 7 cubic feet of this air has been diverted (14.65 minus 7=7.65) to the balance chamber, so only 7.65 cubic feet of water has been delivered to the blow pump storage tank. We still have the same volume of vent air available to drive the inverted bucket pump, but we have cut in half the amount of water delivered to the blow pump storage tank. On the surface, it may appear that we have lost something here, but we did not. The transfer of 7 cubic feet of air from the compressor to the balance chamber is accomplished with far less resistance, since we are not lifting water with this transfer, and the water flow rate into the compressor increased. The time required to fill the compressor was reduced and the time required for each cycle was reduced. Reducing the time required to fill the compressor with water results in more frequent vent cycles and this accounts for the increased capacity of the inverted bucket pump.

The inventor wishes to apologize at this time for subjecting the reader to so much detail in the basic physics of the invention. This lengthy and sometimes tedious presentation was deemed necessary by questions directed to the inventor by knowledgeable people who have observed the working models, and a realization by the inventor that, for many people, Boyle's Law and its applications consisted of a few days' exposure in a high school or college Physics class a good many years ago.

The three major components of this invention are by no means limited to the confines of the water pumping application previously presented, and the efficiencies calculated for this application may be vastly improved in other applications. The previous presentation was based on a real-life situation that provided the seed for the idea. This real-life situation involved a farm in a rural area of North Carolina. Located on this farm was a large stream of water falling through a rocky gorge. Substantial amounts of free energy could be obtained from this fall, and the system presented was designed to economically extract some of this unused energy. The water from the first lift was to be utilized for the irrigation of farm land, and to provide drinking water for livestock. The water from the second lift was to be utilized for a domestic water supply. The total volume of the water falling provided far more energy than needed to fill the water lifting requirements. When the water lifting requirements were satisified, the air supply from the compressor would be automatically diverted to storage tanks for other useful work around the farm. The total fall of the water through the gorge was also more than the 231 feet utilized to drive the compressor. The compressor was placed at the 231-foot level because the use of air at 100 pounds gage pressure met the water lifting requirements, and allowed off-the-shelf items to be utilized for fabricating the apparatus.

The illustration in FIG. 1 shows the water lift being made from the source water feeding the compressor. The water could have just as easily been lifted by the same process from a separate source far distant from the source feeding the compressor. Automatic controls designed into the blow pump and compressor make this possible without loss of air in the supply line between compressor cycles. In effect, the air supply line becomes a large receiver tank through which a number of blow pumps, pumping from different sources, could be fed with one large compressor. Design of the components within the apparatus allows for fully automatic operation without any additional power sources. Design of controls also prevents energy flow from the compressor source when work is not being done.

THE TWENTY-FIVE FOOT FALL

In the September 1977 issue of The Smithsonian magazine, David E. Lilienthal, the former Chairman of the Tennessee Valley Authority, wrote an article concerning the energy lost through the non-utilization of existing water heads in America. On Page 87 of the magazine he stated, "The Corps of Engineers has counted more than 49,000 dams in this country of at least 25 feet in height, which means an ample head of water for the production of power by the new, low-head turbines, yet only a thousand or so are actually equipped to produce power."

An example of how the invention can convert those existing water heads into useful energy sources is illustrated in the following example where one fall having a total water head of 28 feet could be utilized to do useful work with a monetary expenditure far lower than that required for a small hydro-electric installation. The objective of the installation to be outlined is to create a water lift wherein large quantities of water would be elevated 15 feet above the surface of the water head trapped behind the dam. The water lifted would be utilized for controlled irrigation of adjacent farm land, resulting in an appreciable increase in crop yield with a minimum of capital investment.

Because the pressures involved in a 28-foot water head are in a very low range, large hydraulic air compressors could be constructed at a very reasonable cost. The compressor chamber for one such installation could be constructed of 6-inch thick reinforced concrete. The compressor for this installation would have an internal volume of 1000 cubic feet. A rectangular box having the external dimensions of 26 ft. by 21 ft. by 3 ft. would meet these requirements. This box, constructed of reinforced concrete, would be located below the dam on the downstream side, the top of the box being positioned 25 feet below the surface of the water trapped behind the dam. One cycling of this compressor chamber would yield 580 cubic feet of air at 10.85 pounds gage pressure. Again utilizing Boyle's Law to show how this figure was obtained:

$Po \times Vo = Pn \times Vn$ $Po = 15$ pounds (old absolute pressure)

$Vo = 1000$ cubic feet (old volume)

$Pn = 15 + 10.85 = 25.85$ (new absolute pressure)

$Vn =$ unknown $15 \times 1000 = 25.85 \times$ unknown $Vn = 15{,}000/25.85$ $Vn = 580$ cubic feet, meaning we now have 580 cu. ft. of air at 10.85 pounds gage pressure available for work with each cycle.

By means of a suitable air conduit, this compressed air could be utilized by any number of small blow pumps to create water lifts upward to 22 feet. The water lifts could be from water sources totally separated from the water source feeding the compressor chamber. The detailed drawing of the blow pump shows how this could be accomplished but, for the sake of simplicity in this illustration, only one large blow pump will be used.

The blow pump chamber selected for this illustration is constructed in the same fashion as the compressor chamber. It will have an internal volume of 700 cubic feet, with an external height of 3 feet. The blow pump chamber will be located with its top just below the water surface on the upstream side of the dam. A water discharge conduit will carry water from the bottom of the blow pump chamber to a point 15 feet above the water surface, where it will be discharged into a suitable irrigation reservoir. The total lift of this blow pump is 18 feet and the net lift from the water surface is 15 feet.

Transferring the 580 cubic feet of air from the compressor chamber into a full blow pump chamber installed as outlined results in the following new condition:

$Po \times Vo = Pn \times Vn$ $Po = 15 + 10.85 = 25.85$ pounds (old absolute pressure)

$Vo = 580$ cubic feet (old volume)

$Pn = 15 + 7.81 = 22.81$ (new absolute pressure)

$Vn =$ unknown $25.85 \times 580 = 22.81 \times$ unknown $Vn = 14998/22.81$ $Vn = 657$ cubic feet of water lifted with each cycle of the compressor A water lift of 657 cubic feet means that a total of 4,914 gallons of water is lifted to the irrigation reservoir. If a cycle time of ten minutes is required, the flow rate of the water discharge into the irrigation reservoir will be 491 gallons per minute. The construction costs of the two major components (the compressor and the blow pump) in this installation should not exceed that of an average-sized residential swimming pool. Venting the blow pump chamber directly to the atmosphere on this particular lift results in an efficiency rating of over 35%, when calculated with the foot-pound input to foot-pound output formula.

EFFICIENCY OF COMPRESSOR AND BLOW PUMP COMBINATIONS

When the vent air from a compressor and blow pump combination is not utilized to do other useful work, (i.e., its vented directly to the atmosphere), the efficiency of the compressor and blow pump combination will depend on a number of factors. The highest efficiency will result from a low hydraulic head being utilized to make small hydraulic lifts. For example, a hydraulic head of five feet making a hydraulic lift of four feet will have an efficiency factor of well over 60%, even though all the vent air energy is wasted. It should be emphasized at this point, that efficiency is not calculated on flow rate and efficiency will go down as the flow rate from the blow pump goes up. A water head of 100 feet being utilized to lift water 25 feet would result in a high flow rate from the blow pump, but the efficiency of this lift would be low, when calculated on the foot-pound input to output ratio. In many applications, the efficiency of the lift would not be of major importance. In a man-made reservoir with a very limited volume of water, the efficiency of the lift would be of great importance. A unique feature of the hydraulic air compressor and blow pump combination is that it will work even when the water source feeding the compressor is very small. Man-made catch basins for rain or melted snow could serve as the driving power for compressors supplying air to blow pumps located in wells far distant and at higher elevations than the water trapped in the catch basins.

The inverted bucket pump is the only device in this invention that is capable of effecting an energy intensification. When used in this capacity to create a hydraulic lift, such as the one described in the farm example, it is not a very efficient device. The reason for this deserves discussion. The most efficient extraction of energy from the compressed air made available by the compressor will occur when the compression process is duplicated in reverse. The blow pump chamber duplicates this process exactly up to the point where the vent air must be released. It is the release of this compressed air at pressures much greater than atmospheric that cause the high energy losses. The closer the final vent air pressure comes to the initial atmospheric pressure, the greater will be the efficiency of the transfer process. A review of Page 20 of this presentation will show that it only required a vent air pressure of 2.6 pounds gage pressure to give the sunken bucket a positive buoyancy of 239 pounds. This pressure is close enough to the pressure of the atmosphere to create a question, that question being—"What happened to the energy and why wasn't the efficiency appreciably increased when the inverted bucket pump was added?" As pointed out previously, this lift was a hydraulic lift. The full buoyancy of 239 pounds had to be attained prior to the upward movement of the bucket. As the bucket began its ascent, the air bubble trapped within the inverted bucket began to expand and escape outward and upward from the open bottom of the bucket. No work was accomplished by this expanding air bubble because the full buoyancy of the bucket was needed to start the hydraulic lift, and any additional buoyancy that could have been gained from an expanding air bubble could not have been utilized. In a hydraulic lift, most of the energy loss occurred from this spillage air. Calculation will show that increasing the internal volume and the stroke of the inverted bucket will reduce this energy loss, when making a hydraulic lift, but for maximum efficiency, the inverted bucket pump should be used for a gas compressor.

Utilizing the inverted bucket pump as a gas compressor will again duplicate the original compression process in reverse, as in this application, the expanding air bubble is still confined to a closed container and the expansion results in a needed increase in buoyant lift. For example, an inverted bucket is sized so that its final buoyancy will create a lifting force equal to the desired maximum final pressure on the rod driving the gas-compressing piston. A measured and limited amount of compressed air is released into the inverted bucket when it is at the bottom of its stroke. Because the opposing pressure offered by the gas-compressing piston is low at the beginning of the compression stroke, very little buoyant force is needed to start the upward movement of the float. Once the float starts its upward movement, the air bubble within it starts its expansion and will continue to expand until the measured charge of initially supplied compressed air has created the desired maximum buoyancy. In a situation where the gas being compressed is air, and the final discharge pressure to the storage tank will vary according to usage, the air supplied to the float bucket will have to be metered in proportion to the storage tank pressure. If the float bucket is driving, for example, a refrigeration compressor, the final discharge pressure is reasonably fixed, and less elaborate metering devices can be used to attain the desired result of creating a final bubble that will just fill the inverted bucket at the end of the discharge stroke. One-stage high pressure gas compressors with strokes of 20 feet or more would be quite feasible when driven by a large inverted bucket pump supplied with air in such fashion. Staging a series of inverted bucket pump-driven compressors with progressively smaller pistons would allow final compressed air pressures of over 3,000 p.s.i., while utilizing relatively low water heads. Short stroke compressors could also be used to good advantage where high volume low pressure air sources are available. The wash tub in the swimming pool had a stroke of 18 inches and a buoyant force of almost 250 pounds. The expansive energy trapped in the air confined to the bucket when it is at the end of the discharge stroke will naturally be lost when the bucket is finally vented to atmosphere. For this reason, it would be advantageous to make the sides of the bucket as shallow as possible if maximum efficiency is the design goal.

APPLICATIONS

The inventor's intent was not to perfect the most efficient utilization of energy from an existing water head, but to provide an economical alternative to high-cost hydro-electric plants. In many remote areas of the world, the energy of water heads is not utilized because of economic and environmental considerations. The hydropneumatic air compressor makes it possible to utilize some of this energy without dams and with very little environmental impact. In many applications, modified off-the-shelf items could be utilized in the fabrication of the main components. For instance, the railroad tank cars currently used for transporting liquid propane have an internal volume in excess of 4,000 cubic feet, and will withstand pressures of over 200 pounds. Utilizing two of these tanks as compressor chambers fed from a high head water source would provide a very respectable amount of compressed air. The compressor fill valve on such an application could be 16 inches in diameter and the drain valves 36 inches or larger. Timing of the fill and drain valves would allow for a constant supply of compressed air. The 16 inch water feed pipes to the tanks could operate from a siphon effect and no dam would be required. An important point to be made here is that the fill and drain valves do not have to close or open against high pressures and would be operated from separate hydraulic pistons. The fill valve would not close until the compressor chamber is full of water and the pressure within the chamber is equal to the water head feeding the chamber. The drain valve opens when the hydraulic pressure within the compressor has been bled. Very little pressure is required to close or open the valves and kinetic shock does not occur within the compressor or connecting lines. The standard 40 ft. lengths of natural gas pipe line could also be utilized in compressor construction for very high water heads. These pipes are made to withstand pressures of 500 to 5,000 pounds per square inch and come in diameters upward to 42 inches. Compressed air from such an installation could be utilized in a number of applications.

A few other applications are:

(a) providing the power to drive the saws in a remote area sawmill (b) providing power for pneumatic drills in mining operations (c) driving pneumatic pumps to pump oil (d) driving remotely-located small turbines to generate electricity at the point of usage rather than at the water source. (The cost of a conduit to carry air to the turbine would be considerably less than telephone poles and wire, which is the present method of energy transport)

The reader has no doubt thought of applications not previously covered. The applications are almost unlimited, as compressed air is truly one of the alternate energy sources.

An application favored by the inventor would be a remotely-located water head fulfilling the water requirement needs of a small village. The compressor chamber in this installation would be located at the foot of the waterfall. Compressed air from the compressor would be fed to a blow pump located in the village well, and delivering water to an elevated tank. Vent air from the blow pump would provide the aeration air for the village sewage treatment plant.

DESCRIPTION OF THE INVENTION

Figure 1:
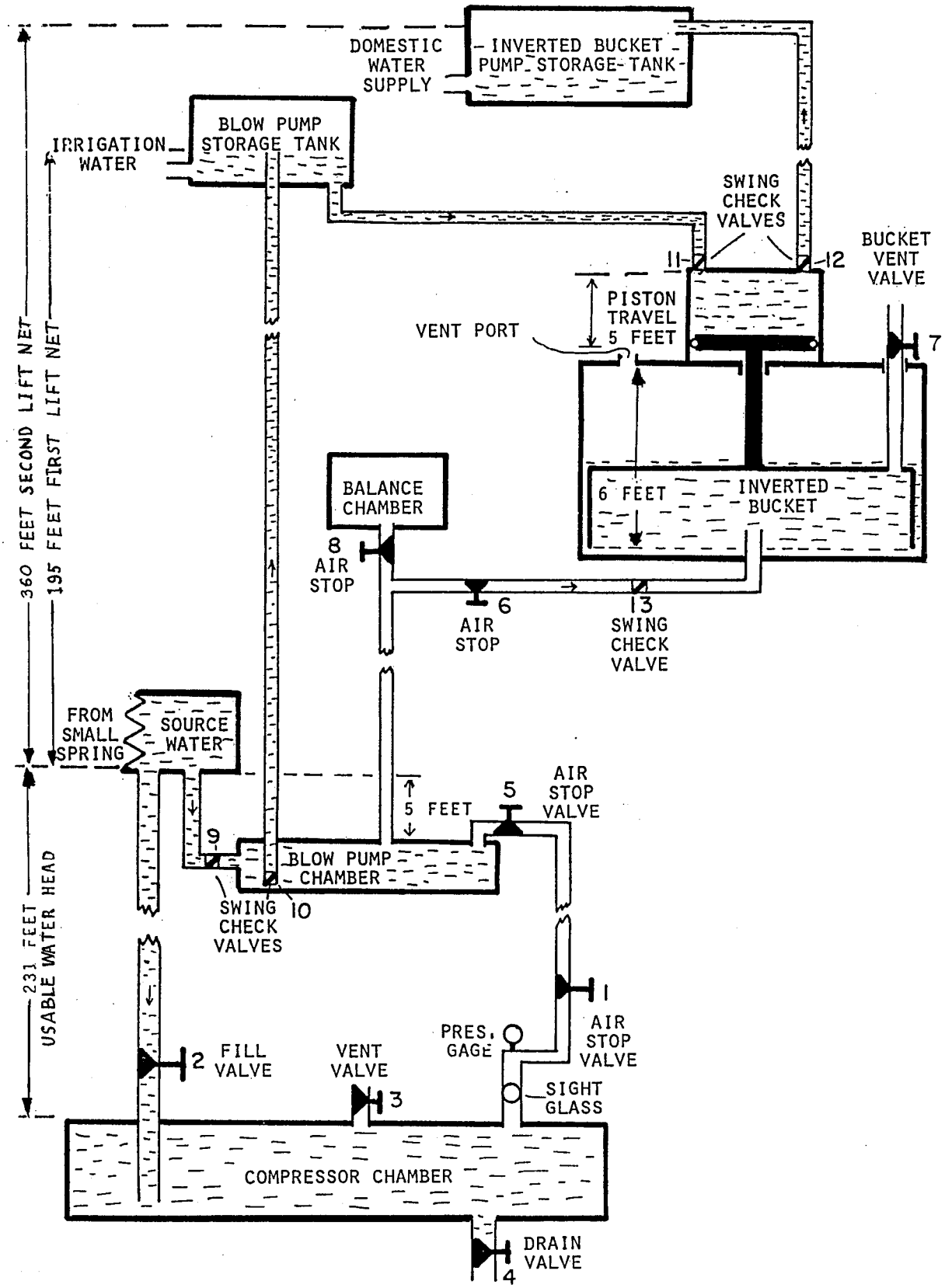
FIG. 1 is a block diagram of the basic hydropneumatic energy transfer system.

FIG. 1 is a functional diagram of a manually operable embodiment of the hydropneumatic energy transfer system adapted to function as a pumping apparatus to extract potential energy from a non-surging head of water and transport that energy as a pneumatic force which pumps a liquid from a first level to a second and third level. A practical application of the embodiment in FIG. 1 would be to pump water from a source such as a small spring having a relatively small static pressure head into a blow pump storage tank having a greater pressure head wherein the water could be discharged to supply an agricultural irrigation system and to supply through swing check valve 11 a high pressure displacement pump driven by an inverted bucket. The high pressure displacement pump transports water through swing check valve 12 to an inverted bucket pump storage tank creating a higher pressure head capable of serving as a domestic water supply.

Functionally the system derives its power from a small spring which serves as a primary water source that is coupled to a compressor chamber via fill valve 2 and a blow pump chamber via swing check valve 9. When vent valve 3 and drain valve 4 are closed, water entering the compression chamber increases the pressure therein and with air stop valves 1 and 5 open, the air in the compressor chamber forces water out of the blow pump chamber and through swing check valve 10 to the blow pump storage tank.

Water in the blow pump storage tank flows through swing check valve 11 into a displacement inverted bucket pump. Air from the blow chamber enters the inverted bucket via air stop 6 and swing check valve 13 or from the balance chamber via air stop 8, air stop 6 and swing check valve 13. This air displaces water in the inverted bucket and as its buoyancy increases, the piston forces water from the displacement pump chamber through swing check valve 12 into the inverted bucket pump storage tank. The inverted bucket pump can be recycled by opening the bucket vent valve to allow air trapped in the bucket to escape.

The compressor chamber which initiated the cycle may be recycled by opening drain valve 4 to permit water which filled the compressor chamber to exit and vent valve 3 to permit air to enter the chamber and replace the water leaving via the drain valve.

THE COMPRESSOR

Figure 2:
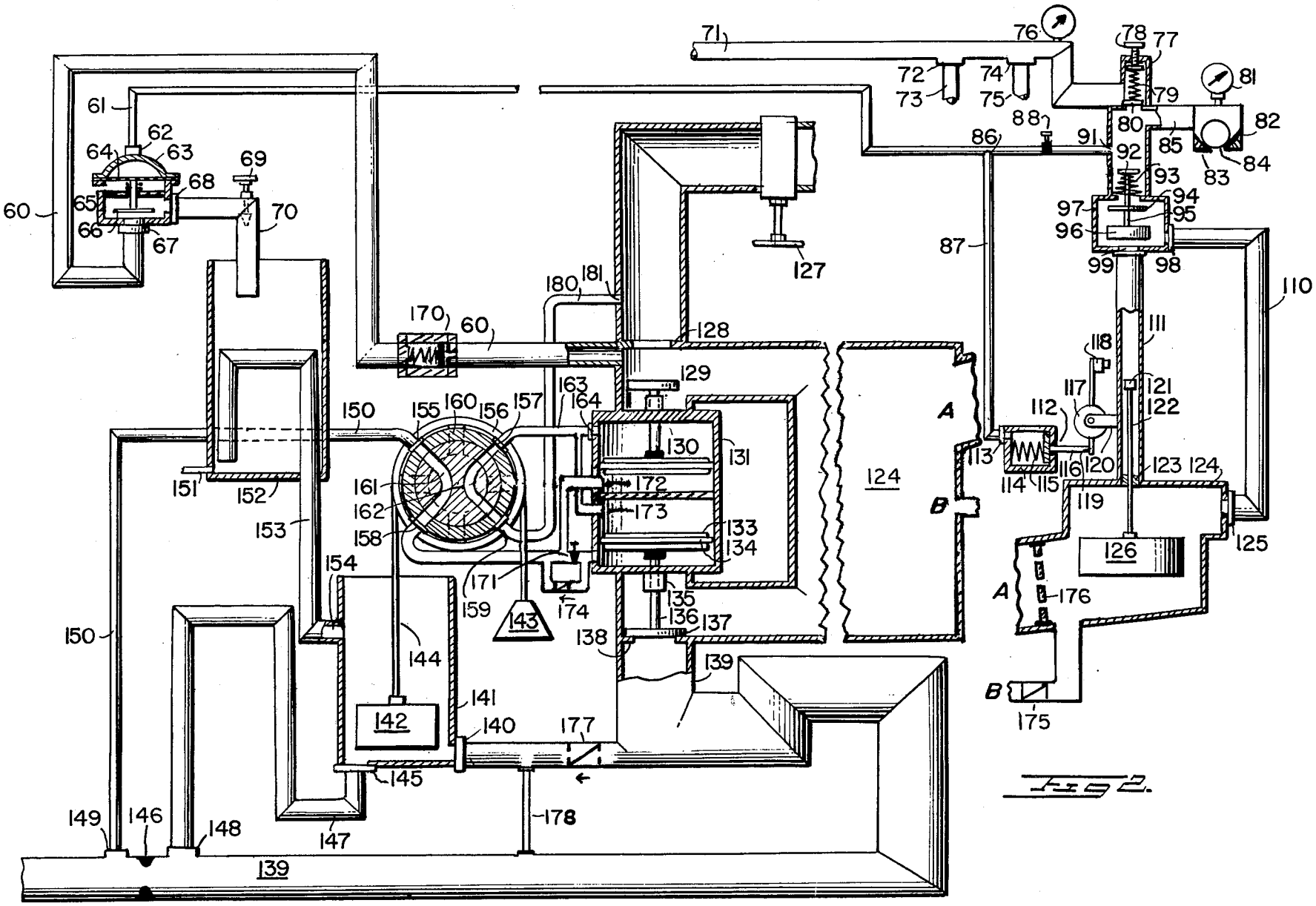
FIG. 2 is a functional diagram of the compressor of a preferred embodiment of the hydropneumatic energy transfer system.

FIG. 2 illustrates the compressor at the start of the water-filling or compression cycle. Compressor chamber 124 has been pre-charged with air at atmospheric pressure by a just-completed drain and vent cycle.

Water hand valve 127 is opened, allowing water from the elevated source to move into the compressor chamber through open valve disc 129, controlled by the fill valve control piston 130. Source water pressure is exerted on conduit 180 at all times after the opening of fill valve 127. Conduit 180 feeds source water to a rotary valve 156, which controls the opening of the fill and drain valve discs 129 and 137 respectively. The illustrated beginning of the fill cycle shows water pressure from conduit 180 being directed through the rotary valve port 157 and into a common conduit 163, which connects to the top sides of the cylinders housing the fill and drain valve control pistons 130 and 133. Pressure being exerted on these pistons from the top side keep the fill valve disc 129 open and off its seat 128, and the drain valve disc 137 on its seat 138. No water flows through conduit 60 at this time because of the spring check valve 170.

Water flowing into compressor chamber 124 causes a compression of the atmospheric air in this chamber, which migrates upward through conduit designated by break "A". Conduit designated by break "B" is closed by check valve 175.

Compressed air moving upward through the chamber housing float 126 moves through conduit 110 and into the chamber housing float 96, to junction point 91, where it is directed through restrictor valve 88 and into conduit 61. Conduit 61 feeds compressed air to the top of the diaphragm controlling valve 65, which is called the pneumatic dump valve. Pressure exerted on the top side of the diaphragm of this valve closes this valve. An alternate path for the compressed air leaving restrictor valve 88 is into conduit 87 and through valve 114 which is presently being held closed by spring 115.

With a pressure build-up on the top side of the diaphragm of pneumatic dump valve 65, all exits from the compressor chamber 124 are closed. Incoming water continues the compression process and the air pressure builds in the uppermost part of the air compressor assembly. When the compressed air pressure has reached a point corresponding to the spring tension setting on valve 77 (at the top right of the drawing), this valve will open and feed compressed air to the users through conduits 71, 73 and 75. Spring-loaded pressure relief valve 77 serves two purposes; it acts as a check valve and it eliminates the possibility of water hammer if no opposing pressures exist in the air supply line 71 during a compression cycle.

Use of compressed air from the air supply conduit 71 causes the water level to rise within compressor chamber 124 and flow upward into conduit designated by brake "A". In this conduit are located a series of restrictor plates 176. These restrictor plates have progressively smaller holes which have a throttling effect on the incoming water, but do not restrict air flow.

Water flow into compressor chamber 124 is greatly reduced through the action of these restrictor plates and water flows into the chamber housing float 126 with a very limited flow rate. Float 126 lifts by means of shaft 122 a piece of iron 121 upward into a non-magnetic guide tube 111. The iron lifted is a round cylinder drilled much like the cylinder of a revolver, so it will not act as a piston.

Movement of the iron 121 upward within the non-magnetic guide tube 111 causes it to reach proximity with a magnet 118 attached by a shaft to wheel 117. When the upward movement of the float causes the iron and the magnet to reach adjacent positions, the magnet is pulled inward toward the iron. This rotates the wheel 117, depressing valve stem 116, which triggers the beginning of the drain cycle sequence.

Valve 114 is constructed very similarly to the common Schrader-type car tire valve. Opening this valve causes air to be bled from conduit 61 much faster than it can be replaced through restrictor valve 88. Pressure is immediately dropped from the top side of the diaphragm on the pneumatic dump valve 65 and this valve opens. Water flow is now possible from conduit 60 through the spring check 170 because water pressure at this time far exceeds spring pressure.

Water flowing through conduit 60 goes through the pneumatic dump valve 65 and through a restrictor valve 69 into conduit 70, where it dumps into siphon chamber 152. Restrictor valve 69 functions as a time delay device. The drain cycle does not actually start until the water being released into siphon chamber 152 is transferred into float chamber 141. This transfer does not take place until the water level in siphon chamber 152 reaches a height sufficient to start a siphon in siphon tube 153. The purpose of the time delay is to insure that all usable space within the compressor assembly is full of water and water flow into the compressor chamber 124 has stopped. Setting this time delay is accomplished by observing gage 81 and adjusting valve 69. The optimum setting will be obtained when the starting of the siphon in siphon tube 153 corresponds with a rapid fall in the pressure on gage 81. Unless radical changes occur in the elevation of the water supply head, this will be a one-time adjustment.

The rapid drop in pressure on gage 81 signaled water flow into the compressor had been shut off by the lifting action of float 96 and the closing of valve disc 94. These events only occur when the compressor assembly is full of water, and water flow into the compressor chamber has stopped.

The simultaneous drop in pressure on gage 81, with the starting of a siphon in siphon tube 153 signals the beginning of the actual drain cycle. Water flowing fom siphon tube 153 flows into float chamber 141. The elevation of siphon tube 147 and check valve 177 prevent water outflow from the float chamber at this time. Drain tubes 178 and 152 are very small tubes which prevent false signals during rainstorms. Water flow through these tubes is negligible.

Float 142 is lifted by the incoming water from siphon tube 153. The lifting of the float 142 causes counterweight 143 to drop. The rotary valve disc 160 is rotated, connecting the water supply tube 180 directly to the bottom side of the piston controlling the water inlet valve 129. The top side of this piston 130 and the drain valve piston 133 are now connected, through the rotary valve, to the drain line 139 and the compressor inlet water valve is now closed by the upward movement of the piston 130. The clockwise rotation of the rotary valve also pressurized the line feeding the bottom side of the piston controlling the drain valve 137. However, this line is provided with a restrictor which prevents upward movement of the drain valve piston until the piston closing the fill valve 129 has reached the top of its stroke. On large systems, this restrictor would take the form of a spring-loaded pressure relief valve.

The drain cycle has now commenced. Water flows out of the compressor chamber through open drain valve 137. A new charge of air at atmospheric pressure is brought in through now-open vent valve 82. Check valve 175 opens to insure a quick drain of the upper assemblies. Water flowing into conduit 139 creates a flow through check valve 177 and drain line 139. Water flowing through check valve 177 causes a slight overflow from float chamber 141, and starts a siphon in siphon tube 147. This siphon is sustained for the duration of the drain cycle by the holdback action of the restrictor 146 in drain line 139.

A complete draining of the compressor chamber allows the siphon created in siphon tube 147 to drain float chamber 141 and the weight of the float rotates the rotary valve back to its illustrated position starting another compression cycle. The restrictor that alowed a time delay in the opening of the drain valve is by-passed by check valve 174 and the opening of the fill valve 129 and the closing of the drain valve 137 is a simultaneous action.

In a preferred embodiment, water enters the compressor from the static head source via gate valve 127 of FIG. 2. When gate valve 127 is opened, water flows past valve seat 128 and into compressor chamber 124. As compression chamber 124 fills, float 126 rises, forcing shaft 122 to slide upward through bushing 123. An iron mass 121 is secured to the top of shaft 122. In a preferred embodiment, the iron mass contains a plurality of small holes bored vertically through its body to prevent hydraulic lock. The mass 121 is contained in a non-magnetic guide tube 111 which also supports master control valve actuating arm bracket 120.

Bracket 120 supports a pivotal control arm mounting means 117 which mounts the master control valve activation cam arm 119 and an operational magnet 118. When the float 126 raises, the iron mass 121, moves upward to a position adjacent to the end of magnetic 118, the magnet is drawn towards the iron mass 121. This action rotates the supporting body 117 causing the cam arm 119 to depress plunger 116 on the master control valve 114. Plunger 116 compresses spring 115 which opens the valve between ports 112 and 113.

Inlet port 113 is connected via conduit 87, T connector 86 and conduit 61 through coupling 62 to the pressure dome of pneumatic valve 63. Port 112 of valve 114 is a vent to the atmosphere so that when the valve is opened as a result of movement of cam arm 119, any pressure in the dome of pneumatic valve 63 is released and diaphragm 64 in valve 63 is allowed to assume its normal, flat configuration as illustrated. This raises rod 65 and attached valve body 66 so that valve seat 67 is opened and liquid in conduit 60 can flow through the valve chamber and out valve exit 68, through the time delay throttle valve 69 and into the timing and float chamber reservoir 152 via discharge conduit 70.

At the beginning of the cycle, as water surges into chamber 124 through valve seat 128, it is contained within the chamber because valve body 137 is firmly seated against valve seat 138. The air within the chamber begins flowing out of compressed air exit 125 into conduit 110. Air from conduit 110 enters the spring check valve 97 and passes through the open valve and out port 91. The air leaving valve chamber 97 through port 91 passes through air restrictor 88 and conduit 61 to pneumatic valve 63.

At this time valve 114 is closed because float 126 is at the bottom of chamber 124 and therefore the air pressure in conduit 61 and through T connector 86 to conduit 87 is not released. This causes the pressure within the dome of pneumatic valve 63 to become greater than that within the valve body and diaphragm 64 is deflected downward, forcing shaft 65 and the attached valve body down against valve seat 67.

As water continues to enter chamber 124, the pressure within conduit 110 and valve 97 increases. This increased pressure is coupled through conduit 85 to air inlet line housing 82 which mounts a pressure indicating gage 81 and an inlet valve 83. Valve 83 contains a ball check valve means 84 which is held closed by the pressure in the housing until such time that the pressure within the system is below ambient pressure. When chamber 124 drains, the pressure falls below ambient and the valve opens to the atmosphere and a fresh charge of air is admitted for the next compression cycle.

The system pressure regulator 77 is a valve preset to open when pressure within the system exceeds a predetermined value, this value is always set to a pressure below the water head feeding the compressor. Screw means 78 adjusts the tension of spring 79 to a predetermined value so that when the pneumatic pressure within the compressor system reaches a predetermiined value, valve body 80 is forced upward and the air is allowed to enter conduit 71. Conduit 71 includes a pressure gage 76 to enable operators to monitor the output system and two or more T connectors 72 and 74 which couple conduits 73 and 75 to auxiliary air storage tanks or alternate systems.

As water enters compressor chamber 124, the water also flows out opening 181 into conduit 180 and through branch 162 of the rotary body 160 of rotary valve 156. The water flows through 162, exiting at vent 157 and through conduit 163 from which it enters the valve control piston chamber 132 via the upper opening 164 of the valve control piston cylinder 131. The main affect of the water pressure entering this system at this time is to hold pistons 133 and 130 down, maintaining valve body 137 seated firmly against valve seat 138 and keeping valve body 129 down and off it's seat 128.

When the iron mass 121 reaches the proximity of the magnet 118, valve 114 is caused to open as previously described. This vents the pressure dome of pneumatic vale 63 and allows water to flow from the compression chamber 124 through conduit 60 and the body of valve 63. The water flowing through valve 63 is restricted by throttle valve 69 and water continues to fill compressor chamber 124 simultaneously with the filling of the float chamber reservoir 152 via discharge conduit 70. When compressor chamber 124 is filled, water is forced up conduit 110 and into the lower chamber of valve 97. Shaft bushing 123 is not a water tight bushing and water is allowed to flow up non-magnetic conduit 111 also so that water enters the lower part of the valve body through opening 99 as well as through opening 98. As this lower chamber in the valve fills with water, float 96 forces rod 95 upward which lifts weighted valve body 94 upward against the valve seat. This valve was normally held open by the weight of float 96. However, the buoyancy of the float causes valve 94 to seal before water enters the upper portion of the valve. This terminates the pressurized air applied by the compressor through valve 77 and spring 79 causes valve 77 to close.

Soon after the closing of valve 97, the drain valve comprised of valve body 137 and valve seat 138 is opened and the water within compressor chamber 124 is allowed to drain. This occurs through the action of the pneumatic valve 66 opening and the flooding of the float chamber reservoir. When the water level in float chamber reservoir 152 exceeds the top of conduit 153, water begins to flow from the reservoir 152 through the conduit via coupling 154 into float chamber 141. As the water level in float chamber 141 increases, float 142 rises and weight 143 suspended by cable 144 from float 142 is allowed to descend. This causes rotary valve 156 to turn. When the rotary valve body 160 has rotated approximately 90°, coupling conduit 162 interconnects openings 158 and 159 and coupling conduit 161 interconnects openings 155 and 157 of the valve body. This causes the valve control pistons in chamber 131 to force pistons 133 and 130 upward due to the sealing action of O rings 134. The water contained in the upper portion of the valve control piston chamber is forced out of opening 164 and 173 through conduit 150 via valve body conduit 161, through T connector 149 and into the compressor chamber drain line 139. This eliminates any hydrostatic pressure preventing the piston from rising. As piston 133 rises, valve body 137 is pulled upward by shaft 136 which is contained in valve guide 135 and connected to piston 133. When valve body 137 is lifted off of valve seat 138, compressor chamber 124 begins to drain. Restrictor 171 creates a time delay in the opening of valve body 137 by impending water flow to the underside of piston 133 and piston 130 is driven to it's full upward position closing fill valve 129 much quicker than drain valve 137 is lifted from it's seat 138 by piston 133.

Water draining from compressor 124 through valve seat 138 is coupled to float chamber 141 via connector 140 in addition to flowing out the compressor drain line 139. Coupling means 140 through check valve 177 ensures one way flow. The drain water from the compressor chamber 124 is permitted to flow into float chamber 141 to ensure that the float 142 will remain at its highest position to maintain the valve control piston at its highest position until the compressor chamber 124 is completely drained.

When the water level in float chamber 141 exceeds the top of the upper most section of siphon conduit 147, water begins to siphon out of float chamber 141 via T connector 148 into the compressor chamber drain line 139. The water will continue to siphon out of float chamber 141 until the chamber is completely emptied, which occurs after the float chamber reservoir has been emptied and the compressor chamber 124 has been emptied. At this time the weight of float 142, not supported by water, raises weight 143 and rotates valve body 160 back to the position illustrated in FIG. 2 which commences a new cycle by permitting water to flow from conduit 180 through valve body conduit 162 into the upper portions of the valve control piston chambers. This action opens valve body 129 and valve seat 128 and closes valve body 137 and valve seat 138. Simultaneous valve action occurs at the commencement of the fill cycle because in this mode restrictor 171 is by-passed by check valve 174.

A relatively small bleed line 151 is provided in the float chamber reservoir to ensure that that reservoir is completely drained at the termination of a cycle and prevents false cycle from rain or splash.

As water is draining from the compressor chamber 124, the ball check valve 83 raises due to the pressure within the compressor chamber 124 falling below atmospheric pressure. This permits a fresh charge of air to enter compressor chamber 124 via vale 83 during the dump phase of the cycle while compressor chamber 124 is being emptied of water.

In the preferred embodiment, a supply source of water at inlet valve 127 has a static head equivalent to a column of water 231 feet high and it will produce a pressure of 100 pounds in the compressed air output line 71.

Valve 77 is preset to approximately 90 pounds of pressure to allow for a light margin under the 100 pounds available to the system from the water head. Shut-off valve 127 is open and the source of water enters the compression chamber 124 at the compressor chamber fill valve formed by valve body 129 in valve seat 128. As chamber 124 fills with water, air pressure builds up, due to the compressing of the confined air trapped above the incoming water. This compressed air is directed through pipe 110 and open valve 97. This air flows through restrictor valve 88 to the top of pneumatic valve 83 and causes the valve to close.

The magnetic operated bleed valve 114 is closed because float 126 is down.

At this point in the cycle, the compressor chamber 124, with the exception of the open fill valve 129/128, is closed. The compression of trapped air continues and when the pressure builds up to 90 pounds, preset valve 77 opens and allows the air to pass into the air supply line 71.

Compressed air being used from the supply line causes the compressor chamber 124 to continue filling with water. Float 126 lifts, causing the iron mass 121 at the top of shaft 122 to rise in the non-magnetic guide tube 111. When the iron mass 121 reaches the proximity of the magnet 118, the magnet pulls toward the iron mass. This opens valve 114 which is the master control valve. Restrictor valve 88 limits the volume of air fed to pneumatic valve 63 and is adjustable to accommodate different supply heads. The opening of the master control valve 114 initiates the drain cycle. It does this by causing an immediate drop in the air pressure from the top of the diaphragm 64 in the pneumatic valve 63.

The pneumatic valve opens and allows water from the compressor chamber 124 to enter the float control reservoir 152. A time delay is provided at this point in the cycle by the action of the siphon conduit 153. The time delay is the time required for float chamber reservoir 152 to fill, over the draining action of bleed line 151, to a point above the highest point in the siphon conduit 153. The object of the time delay is to allow the compressor chamber 124 to fill completely with water prior to draining. The duration of the time delay depends on the pressure of the source water head and is adjusted by throttle valve 69. This adjustment is made by observing pressure gage 81 at the top of the inlet chamber 82. A rapid fall of this pressure indicates that the compressor chamber is full of water and that float 96 has lifted, closing valve 97. Optimum adjustment is normally accomplished when the rotation of rotary valve 56 corresponds with the fall in pressure gage 81. This is a one time system adjustment and will not require changes with a fixed head of water supplying the compressor.

Siphon tube conduit 153 located within float chamber reservoir 152 ensures a positive action of the rotary valve 156 and, by providing a water reserve, keeps float 142 up while the valve control piston 133 shifts and compression chamber drain line 139 fills. The drain cycle now commences and vent valve 84 opens automatically to bring in a fresh charge of air for the next compression cycle.

The valve control pistons 133 and 130, having moved upward, keeps the fill valve 129/128 shut and the drain valve 137/138 open. Water flow to pneumatic dump valve 63 stops. A restrictor 146 in the compressor drain line 139 downstream of the siphon conduit 147, T connector 148 is dimensioned so that some drain water overflows the top of float chamber 141 to ensure operation of the siphon conduit 147.

A complete draining of the compressor chamber 124 stops water flow into the compressor drain line 139. Siphon conduit 147 empties float chamber 141, causing float 142 to drop and rotate rotary valve 156 to restart the next compression cycle.

Operation of the compressor is completely automatic once a first compressor cycle is initiated. However, when air in the pneumatic line 71 is not utilized, the system will automatically stop. This occurs because the air pressure in conduit 71 equals the air pressure in the compressor chamber at the highest point of compression in the compressor chamber and valve 77 fails to open. This build up of air pressure under valve 77 stops water flow into the compressor chamber 124. This automatic stopping action occurs because air pressure builds up within the compressor chamber 124 to a point wherein water can no longer enter and this occurs before enough water enters the compressor chamber to cause float 126 to raise to a point which will activate the master control valve 114 via the iron mass 121 and magnet 118.

THE BLOW PUMP

Figure 3:
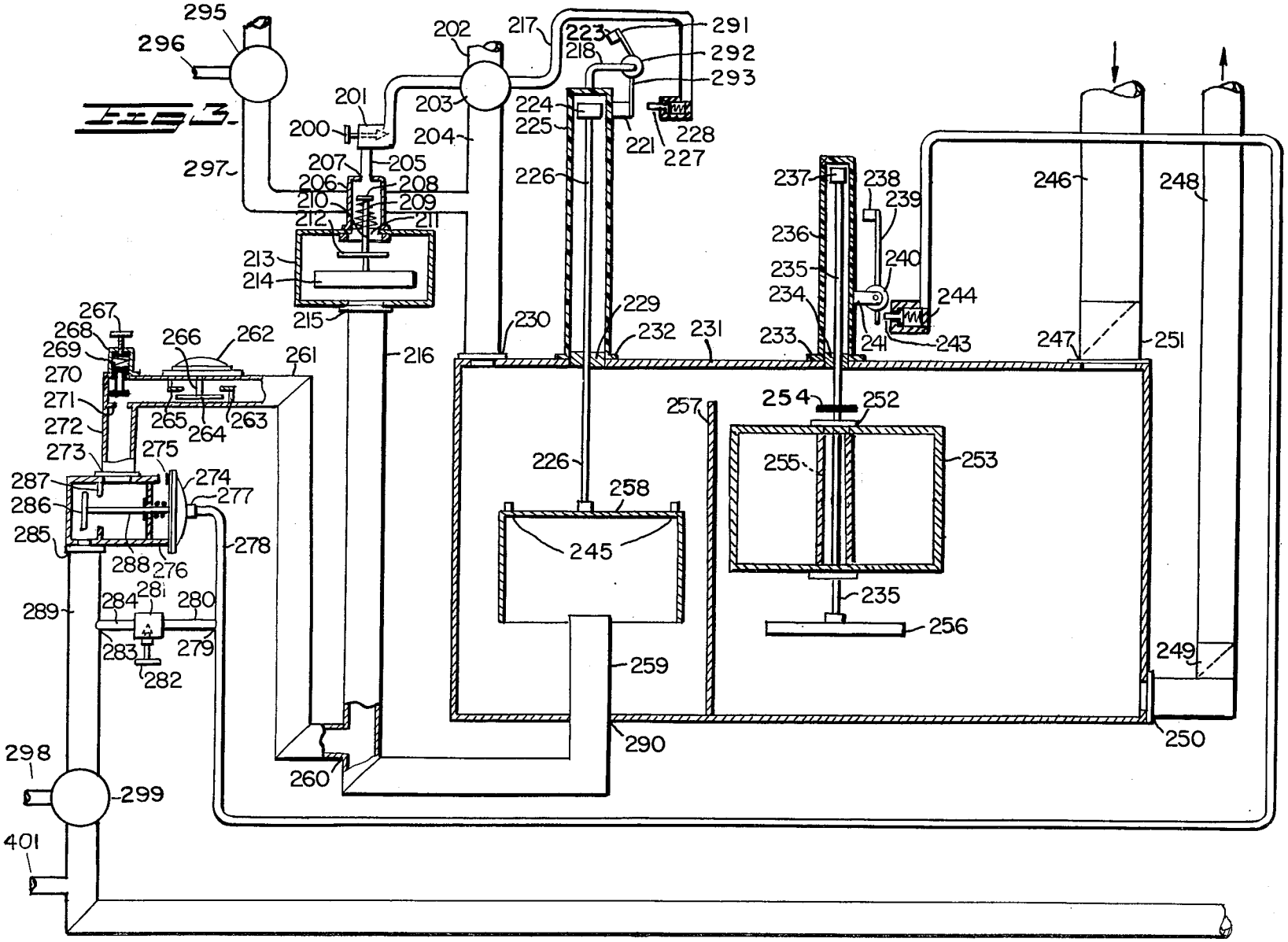
FIG. 3 is a functional diagram of the blow pump of a preferred embodiment of the hydropneumatic energy transfer system.

The blow pump illustrated in FIG. 3 shows the location of all operational components, when an above-ground gravity-fed blow pump is utilized. Diaphragm-type pneumatically operated valves 203 and 295 are always located above the highest level of the source water.

Alternate installations of the blow pump could be readily accomplished with slight modification of the assembly shown. Installation of the blow pump within a well could require the submergence of the blow pump chamber 231 and an elevation of all other external components. All components to the left of conduit 261 would be moved to an above-ground elevation. Float chamber 213 housing float 214 would be placed at a level slightly below the lowest expected water level in the well. By means of conduit extensions, guide tube extensions, and float shaft extensions, all other external components would be elevated to an above-ground level location. Source water conduit 246 would be eliminated and source water check valve 251 would be relocated to the under side of blow pump chamber 231. This modified configuration would readily adapt to a situation where it is desired to have the blow pump assembly floating on a pond or lake. In this type of installation, the blow pump chamber 231 would be firmly attached to the under side of a floating platform and all other components would be relocated as outlined.

Three valves within the assembly shown in FIG. 3 are optional valves and may or may not be required, dependent upon the installation requirements. The first of these optional valves is a pressure regulating valve, the stem of this valve being denoted by the number 264. This valve would only be necessary if the construction material used to fabricate the blow pump chamber could not withstand the pressure of the available air supply (i.e., an air pressure of 300 pounds could be utilized to drive a blow pump with a 50-ft. lift). It would be foolish and expensive to construct a blow pump that would withstand 300 pounds pressure to make this 50-ft. lift.

The other two optional valves in the system are diaphragm-type pneumatically operated valves similar in construction to valve 276 illustrated in the blow-up. Any pneumatically operated valve referred to within the system will have this same basic construction. However, the only valve in the system that opens with a pressure exerted on the top side of the diaphragm is valve 276, illustrated in the blow-up. All other pneumatically operated valves within the system close when air pressure is applied to the top sides of their diaphgrams. The two optional valves in the illustration FIG. 3 are pneumatic valves 299 and 295, which are controlled by float operated rotary valves in the storage reservoir.

Control air for the optional valves 299 and 295 is taken from the main air supply line through conduit 401. Control air is delivered to the top side of the diaphragms of these valves, through the float operated rotary valves and conduits 298 and 296. Pneumatic valve 295 brings the optional balance chamber into the system. The purpose of the balance chamber is discussed fully in the presentation. Pneumatic valve 299 stops all air flow in the blow pump it is controlling. A full blow pump reservoir will lift the float, causing a rotation of the rotary valve (not shown), and this upward movement of the float causes a change of flow within the rotary valve. The port connecting conduit 298 to the atmosphere is closed and line air pressure is allowed to flow from conduit 401 into conduit 298, where it is applied to the diaphragm of valve 299, closing this valve and stopping all air flow into the blow pump it controls.

The blow pump design as shown in FIG. 3 is much more sophisticated than that which would be necessary to accommodate the one-compressor/one-blow pump combination outlined in the presentation. The primary purpose for this sophistication was to make it possible for a large number of blow pumps to be operated from a common compressed air source, each pump to be lifting from its own water source and delivering to separate reservoirs. The blow pump design illustrated by FIG. 3 will work with an intermittent compressed air supply. However, the efficiency of the blow pump lift will be greater if a reasonably constant compressed air pressure is maintained in the compressed air supply line. Compressed air supply line pressure that falls below the equivalent pressure of the hydraulic head created on the discharge side of the blow pump will stop air flow into the blow pump chamber, and trigger a vent cycle. This premature venting of the blow pump chamber will result in an efficiency loss.

Because of the sophistication of the controls within the blow pump assembly, a quick run-through of the delivery cycle will be presented to show air and water movement through the pump on the delivery cycle. A second cycle will be presented to explain in detail the purpose and function of each control.

The illustration FIG. 3 shows the pump making its delivery cycle. Compressed air is flowing through pneumatic valve 299 and upward through conduit 289. Air pressure is being exerted on the dome of the diaphragm valve 276, through restrictor valve 281 holding valve disc 286 off its seat. Air is flowing upward through open valve 268 and valve 262. Air moving down conduit 261 exerts a pressure on conduit 216, which is transmitted upward to the diaphragm of pneumatic vent valve 203 holding this valve shut. Air moving downward from junction point 260 is directed to the blow pump through conduit 259. Air moving through conduit 259 has blown all water from the interior of the inverted bucket type float 258. The buoyancy of this float is keeping it upward in the position shown. Air is flowing out of the bucket from its open bottom and a small amount of air is moving through the open vent holes 245. Air bubbles leaving the bucket migrate upward through the water trapped within the bucket chamber because of baffle plate 257. These upward migrating air bubbles create a downward force on all water trapped within the chamber. When this downward force exceeds the opposing hydraulic force created by the static head in the water discharge line 248, water will be forced out of the chamber through check valve 249. Water trapped within the compartment housing the inverted bucket float 258 cannot leave this compartment because of the elevation of baffle plate 257.

A continuing supply of compressed air at pressures greater than the opposing hydraulic head created by the water in conduit 248 will cause all water to be blown from the compartment to the right of baffle plate 257. This blowing of water from the right hand compartment causes float 253 to lose its positive buoyancy, which triggers the drain and vent cycle of the blow pump.

The Second Cycle

The termination of the blow cycle was caused by the downward movement of float 253 as the water level receded in the section of the blow pump chamber to the right of baffle plate 257. Float 253 is free to move up and down on a non-magnetic shaft 235. Fastened securely to the top of shaft 235 is a piece of iron drilled in a fashion similar to the cylinder of a revolver, so that it cannon act as a piston. The iron centered within the non-magnetic guide tube 236, can move up and down within this tube. The illustration FIG. 3 shows the iron at the top of this guide tube. With a full blow pump chamber, the holding float 256 has enough positive buoyancy to hold the iron in its illustrated position. Water being blown from the chamber causes the large float 253 to drop and come into contact with float 256. When float 253 has lost all of its buoyancy, its weight is sufficient to overcome the buoyancy of float 256 and push it downward. As float 256 is securely-fastened to shaft 235, the iron 237 also moves downward in guide tube 236. When the downward movement of the iron has placed it in a position parallel with the external magnet 238, the magnet will be pulled toward the iron and be held there until the blow pump chamber refills with liquid.

Magnet 238 is fastened to a non-magnetic shaft, which extends through a pivot wheel 240. The magnet being pulled toward the iron causes the bottom of shaft 239 to depress a stem on a valve 244, which is very similar to a car tire valve. This action causes an immediate bleed of the air pressure in conduit 278, dropping all pressure on the diaphragm and closing valve 276. Restrictor valve 281 cannot supply compressed air to conduit 278 as fast as it is being bled through open valve 244. The bleed from valve 244 will continue until the blow pump chamber has refilled with liquid from its feed source.

The closing action of valve 276 causes all air flow into the compressor chamber to stop. Inverted bucket float 258 loses its positive buoyancy as the air trapped within it, which has made it buoyant, escapes through small holes in its top 245. The bucket float sinks within the liquid still trapped to the left of baffle plate 257. Non-magnetic guide stem 226 is provided with a piece of iron at its top, identical to the iron previously described. Movement of this iron down the non-magnetic guide tube 225 pulls it away from a parallel position with external magnet 221. Pivot wheel 292 is rotated counterclockwise by counterweight 223, and non-magnetic shaft 293 depresses the stem on valve 228. The opening of valve 228 bleeds the pressure from conduit 217, releasing the pressure on the top side of the diaphragm on pneumatic vent valve 203. The closing air for valve 203 comes through restrictor valve 201, and cannot match in volume the air being bled through open valve 228.

The opening of pneumatic vent valve 203 releases all compressed air trapped within the blow pump chamber. This released air can be routed through an inverted bucket pump for an additional energy extraction or it can be vented directly to the atmosphere.

When the air pressure within the blow pump chamber drops to a point below the pressure of the hydraulic head of the liquid feed, check valve 251 will open, allowing feed water to re-enter the blow pump assembly. As the compressor chamber refills with liquid from the feed source, float 253 again becomes buoyant. Its upward movement causes flange 252 to contact a fixed collar 254 on non-magnetic shaft 235. Increased positive buoyancy of float 253 causes the iron to break its hold with external magnet 238 and it is pushed upward into the non-magnetic guide tube 263 to its illustrated position. This action closes valve 244 and a gradual pressure build-up occurs in conduit 278 through restrictor valve 281. This gradual build-up of pressure on the diaphragm opening valve 286 creates a time delay to allow complete filling of the blow pump chamber and the chamber housing float 214. Float 214 lifts when chamber 213 is flooded and closes valve 211 to prevent water entry into the restrictor valve 201. During this time delay, water will also rise into the vent tube 204, to a level equal to the upper level of the incoming source water. In effect, this water-filled portion of the vent tube increases the filling capacity of the blow pump, and over-sizing the vent line in this area will result in a greater liquid discharge volume with each blowing of the pump chamber.

When the time delay, caused by the action of restrictor valve 281, is over, pressure will again build on the top side of the diaphragm of valve 276, pushing the valve disc 286 away from its seat and compressed air from the supply air line will be allowed to move into conduit 272, where it will encounter valve 268. Valve 268 is a simple spring-loaded pressure relief valve that acts as a check valve, and also serves as a blow pump priority valve. Adjustment of the spring tension of this valve, with adjusting knob 267, assigns priorities to individual pumps fed from a common air line.

A build-up of air pressure sufficient to overcome the tension set on spring 269 opens the priority valve 268, and releases it to the optional pressure regulator valve 265. Air flowing downward to junction point 260 splits into two paths. Air flowing upward into conduit 216 starts displacing the water trapped in float chamber 213 downward. Water displaced downward by this action flows through conduit 159, along with the compressed air. The water being displaced from float chamber 213 and bucket float 258 causes a momentary rise of liquid in vent conduit 204, since pneumatic vent valve 203 has not at this point closed. Float 214 in float chamber 213 drops at almost the same instant that bucket float 258 becomes buoyant. The dropping of float 214, caused by the downward displacement of water from float chamber 213, opens valve disc 212 and makes compressed air flow through restrictor valve 201 into the diaphragm dome of pneumatic vent valve 203. In almost a simultaneous action, bucket float 258 attains full buoyancy, moving iron 224 up the guide tube, where it again gains proximity with external magnet 221, closing bleed valve 228 through the clockwise rotation of wheel 292. This action closes the pneumatic vent valve 203 and starts the second blow cycle. Water, trapped in the vent line 204 by the closing of pneumatic vent valve 203, drains by gravity into the blow pump chamber 231 and flows over baffle 257, where it is blown to the reservoir through conduit 248.

When a reasonably constant supply of compressed gas is available to the sophisticated blow pump illustrated, the addition of a blance chamber, explained in the presentation, will not change the quantity of water delivered from the blow pump with each cycle. A balance chamber added to a blow pump of this design will only increase the amount of vent air available at the end of each cycle.

Figure 4:
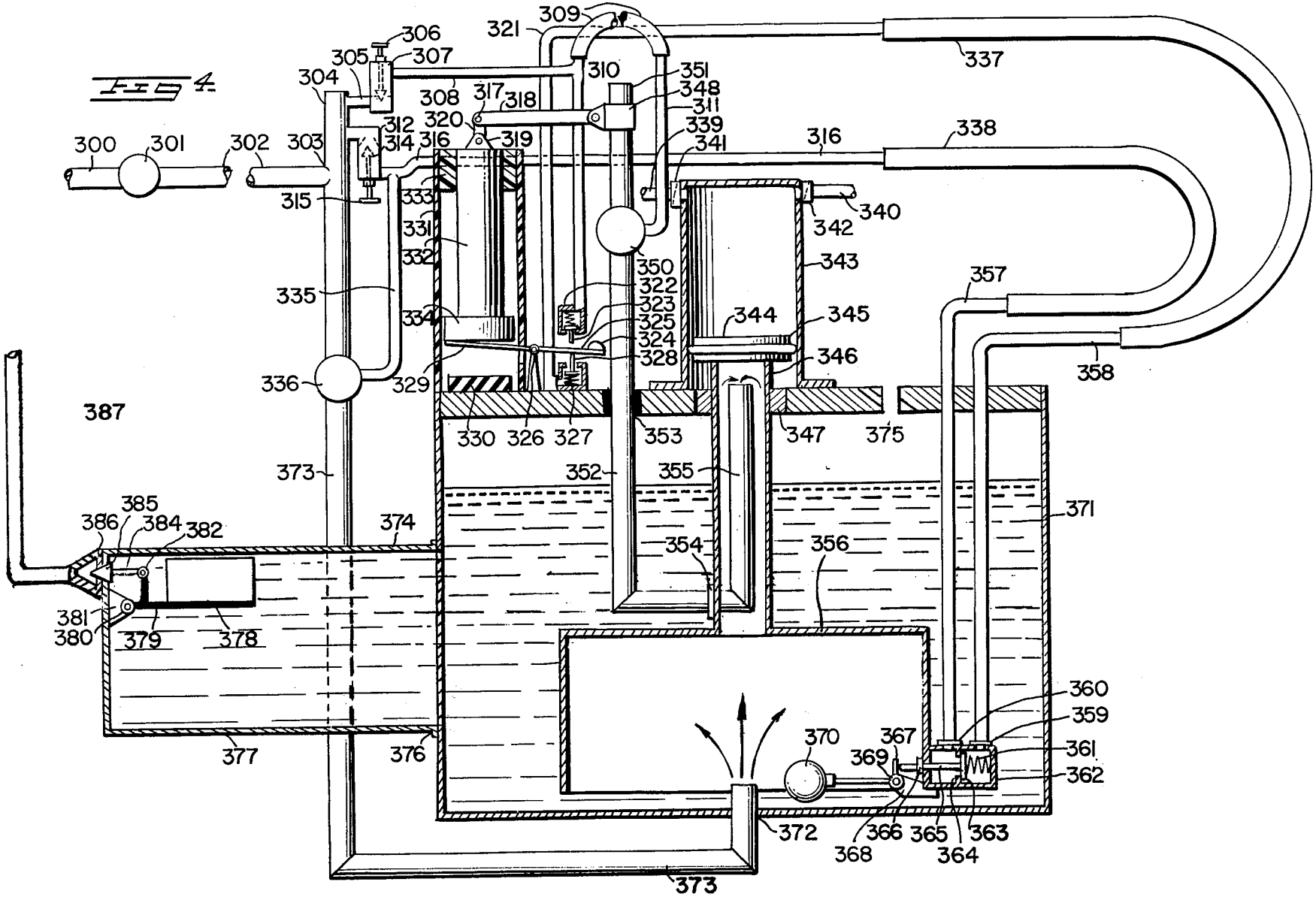
FIG. 4 is a functional diagram of an inverted bucket pump embodiment of the subject invention.

A preferred embodiment of the blow pump is illustrated in FIG. 3. In includes an air and water tight chamber 231 which receives fluid via conduit 246 from a primary source. The fluid in conduit 246 flows into the pump chamber 231 via one-way check valve 251 which is sealed to the chamber at inlet 247. As water fills chamber 231, air is driven out of the chamber via conduit 204 secured to the chamber at outlet 230. A pneumatic vent valve 203, positioned above the head of the liquid supply source, permits the air to vent from chamber 231 and into conduit 202 which may be used to supply an additional pump such as the inverted bucket pump. When pump chamber 231 is filled with liquid, air from a compressor such as FIG. 2 or FIG. 4 is permitted to enter the chamber. This compressed air forces liquid through the one-way check valve 249 coupled to the lower portion of chamber 231 at outlet 250. The output of one-way check valve 249 is coupled to a suitable reservoir by conduit 248.

As illustrated, FIG. 3 depicts the system as it commences the blow cycle where liquid in chamber 231 is being forced through check valve 249 by air entering the chamber through conduit 289. Fluid has filled chamber 231 and raised float 256 so that the iron mass supported on shaft 235 is held at the top of the non-magnetic sleeve 236 sealed to the top of chamber 231 at 233. The shaft 235 is stabilized within the non-magnetic closed top tube or sleeve by bushing 234. Bleed valve 244 is a normally closed Schraeder type valve activated by push rod 243. With the iron mass 237 at the top of the non-magnetic sleeve 236, valve 244 is closed and conduit 278 is pressurized by air coupled through conduit 280 to T connector 279.

Air from the compressor is provided to the system via conduit 289 which is coupled to pneumatic valve 276 at port 285. Upstream of the coupling to pneumatic valve 276 is a T connector 283 which permits air to be bled off of conduit 289 via conduit 284. The air in conduit 284 passes through restrictor valve 281 and conduit 280 to conduit 278 which is coupled at 277 to the pressure dome 274 of pneumatic valve 276. A control level 282 is provided to adjust restrictor valve 281 to achieve proper operation of pneumatic valve 276 when bleed valve 244 is activated. As illustrated in FIG. 2, Schraeder type valve 244 is closed and the pressure at T connector 283 of conduit 289 is felt in the dome of pneumatic valve 276. Since T connector 283 is upstream of coupling 285 to pneumatic valve 276, the pressure in the dome of the valve is greater than the pressure below the diaphragm, the bottom side of which is vented to the atmosphere at port 275, and air begins to flow and diaphragm of valve 276 is deflected, forcing push rod 288 and the supported valve body 286 toward the base of the valve chamber and away from valve seat 287. This permits air to flow through valve 276 via conduit 272 which is attached to valve 276 at orifice 273. The air pressure being greater than spring pressure opens priority valve 268 and flows through the normally open pressure regulator valve 262 into conduit 261. Conduit 261 is coupled to conduits 216 and 259 through which the air flows into chamber 231 and via float valve 213 into the pressure dome of pneumatic vent valve 203 to maintain that valve closed to prevent venting during the pump discharge cycle. A controllable restrictor or regulator valve 201 including a control thumb screw 200 couples pneumatic valve 203 to float valve 213 exhaust port 207 via a small conduit 205. This adjustment means is provided to limit volume of air flow to the diaphragm of vent valve 203 and allow Schraeder valve stem opening 227 to vent this limited volume of air to the atmosphere when valve 228 is actuated by the pressing action of 293.

Priority valve 268 provides a means wherby priority can be granted to a selected blow pump when two or more pumps are fed from the same air source. This is accomplished by increasing the spring pressure on the pumps with least priority and reducing the spring pressure on pumps with the greater priority. Adjustment in this fashion will result in a condition where the pump with the most lift can be given priority on the air supply until the tank it feeds is full of water. Example: two blow pump chambers on same air supply line. Chamber with most lift is for domestic water and has priority over irrigation lift which is less. Floats in tanks stop air when tanks are full.

The pressure regulating valve 262 includes a closed pressure dome which maintains a diaphragm in a relatively unflexed position holding push rod 266 down so that valve disc 264 is clear of valve seats 265 and 263. A spring means is provided within the pressure dome of valve 262 to ensure that the valve remains open until a predetermined pressure is exceeded within conduit 261. When this occurs, the diaphragm of valve 262 is deflected upwards and valve disc 264 is drawn firmly against the valve seats 265 and 263 where it remains until the pressure within conduit 261 on the pump side of the valve decreases to a safe level. At that time, the valve will automatically open. However, if pressure in the line exceeds the safety margin, the value will close as soon as the pump chamber 231 absorbs the additional pressure and reaches the maximum safe limits as set by valve 262.

FIG. 3 shows blow pump float bucket with air applied: prior to starting the discharge cycle, float bucket 258 was resting on the top of conduit 259 because any air which was trapped within float bucket 258 prior to the opening of pneumatic valve 276 was released through bleed vents 245. Thus the iron mass 224 supported by shaft 226 within the non-magnetic sleeve 225 was at its lowest position. Shaft 226 is steadied within the system by bushing 229. With the iron mass 224 at a lower position than that illustrated, magnetic means 221 supported by rod 293 from the rotating body 292 was pushed against valve stem 227 by the action of weight 223 supported on rod 291 from the rotating body 292. The rotating body 292 is supported by a brace 218 which may be secured to the top of the non-magnetic cylinder 225. When the weight 223 causes body 292 to rotate and force rod 293 against valve stem 227, the normally closed Schraeder valve 228 is opened and the pressure dome of pneumatic valve 203 is bled to atmospheric pressure in the same fashion as a car tire can be deflated by pressing in the valve.

When the pressure dome is at atmospheric pressure, pneumatic valve 203 was open allowing chamber 231 to vent. As the blow cycle starts and air enters conduit 216, valve 203 will remain open because restrictor valve 201 is adjusted so that the amount of air permitted to pass therethrough is less than the air vented by valve 228 in its open condition. However, as air enters float bucket 258 at a rate greater than can be expelled through bleed vents 245, the iron mass 224 is raised by the now buoyant bucket to the approximate vicinity of magnet 221. This attracts the magnet and permits valve 228 to close. With valve 228 closed, the air flowing through float valve 213 and regulator valve 201 causes pneumatic valve 203 to close, shutting off the air vent means for chamber 231. As additional air enters through conduit 259, which is sealed in an opening 290 in the bottom of chamber 231, liquid is forced out of the chamber through check valve 249. As water is forced out of chamber 231, float 253 begins to descend along shaft 235. Float 253 contains a bore 255 which permits it to ride up and down shaft 235 between flange 254 and float 256.

As the level of the water within chamber 231 lowers, float 253 bears on float holding flange 256 and causes the iron mass 237 to lower within the non-magnetic chamber formed by cylinder 236. As the iron mass 237 approaches the magnetic means 238, the magnetic means is drawn towards the mass and shaft 239 causes rotation of the rotating body 240. This causes shaft 242 to depress valve stem 243 and open the normally closed Schraeder type valve 244 to vent conduit 278. The length of shaft 235 is adjusted so that this occurs when the majority of the water has been exhausted from chamber 231 and before air has a chance to enter the check valve 249. When conduit 278 is vented via valve 244, pressure within the pressure dome 274 of pneumatic valve 276 becomes less than the pressure within the valve chamber and valve body 286 is drawn against valve seat by spring under diaphragm of valve seat 276 to terminate the blow cycle.

When pneumatic valve 276 is closed, air no longer enters float bucket 258 via conduit 259 and the air contained therein slowly bleeds out of vents 245 allowing the bucket to sink. As the bucket sinks, iron mass 224 is drawn away from the magnet 221 and weight 223 causes the rotating body 292 to pivot, forcing rod 293 to depress valve stem 227 and open bleed valve 228, which causes an immediate drop of pressure on the top side of the diaphragm of pneumatic vent valve 203 and valve 203 opens.

With vent valve 203 open and pneumatic valve 276 closed, the fill cycle begins with liquid flowing into chamber 231 via check valve 251. Divider 237 forms a secondary water chamber which is not drained by the blowing action and water in this secondary chamber is forced into conduit 239 by the air pressure created within the chamber 231 as water enters through check valve 251. Water entering conduit 259 flows up conduit 216 and into float valve 213. This causes the float 214 to raise and press valve body 212 against the valve seat 211. The top portion of valve 213 includes a housing 206 which accommodates a valve float and body supporting shaft 210 and valve body support spring 209 and spring retainer 208. When float valve 213 is closed by the action of rising water through the lower orifice 215 of the valve chamber, the source of pressurizing air to pneumatic vent valve 203 is cut off to ensure that the vent stays open. However, when pump chamber 231 fills in the following cycle, Schraeder valve 244 is closed and pneumatic valve 276 opens forcing air through conduit 261 and into the T connector 260. The action of the air flowing through conduit 259 draws the water out of conduit 216 and permits float valve 213 to open and allows the water to be purged from that portion of the system so that by the time iron mass 224 is raised to a point where it will permit bleed valve 228 to close, the water will have been drained from float valve 213 and air pressure within conduit 216 will pressurize pneumatic valve 203 and close the vent as previously described.

THE INVERTED BUCKET PUMP

The inverted bucket pump illustrated in FIG. 4 is a totally self-contained pumping assembly, designed for above-ground installation, utilizing a high-volume, very low-pressure compressed air source as its energy source to accomplish a hydraulic lift.

The high-volume, low-pressure compressed air source is being directed to the underside of a shallow inverted bucket, submerged within the confines of a container partially filled with any suitable liquid. The liquid within this container is necessary only to create a medium for buoyancy, and does not have to be connected in any way with the liquid being pumped through the conventional piston pump (which is being driven by the reciprocating action of the inverted bucket).

The container enclosing the inverted bucket could be eliminated for a floating installation of the pump assembly. The inverted bucket in this type of installation would be suspended under a heavy floating platform and all other mechanisms would be above the platform. A large reservoir, a pond or a lake could be the floating medium for such an installation.

The piston stroke of the inverted bucket pump illustrated in FIG. 4 is limited to ten inches in order to facilitate graphic presentation. Slight modifications of the illustrated control mechanisms would be necessary if longer piston strokes are used. Slight modifications of the control mechanisms would also be necessary if the illustrated inverted bucket pump is utilized as a gas compressor. These modifications will be explained in the presentation of the operating sequence.

A cursory look will be given to the first cycle of the inverted bucket pump to show air and water movement within the assembly. A second cycle will be made with a detailed explanation of all control devices.

The First Cycle

The inverted bucket pump illustrated in FIG. 4 is shown at the start of a delivery cycle. The conventional piston-type pump, illustrated with piston 344 in a down position, is full of liquid. Inverted bucket float 356 is full of slightly compressed air. The compressed air, utilized to displace all liquid from the inverted bucket, has been shut off by the downward movement of float 370. The liquid displaced from within the float bucket 356 has moved upward into chamber 371, which is open at the top through vent port 375. Maximum buoyancy of the inverted bucket 356 has been obtained and the inverted float bucket begins ascending. Ascension of the inverted bucket 356 causes piston 344 to move upward, forcing check valve 342 open and a liquid delivery through conduit 340. Full upward travel of the piston 344 automatically terminates the delivery cycle of the liquid pump, by venting compressed air from the inverted bucket 356. The release of compressed air from the inverted bucket 356 causes the inverted bucket to fill with the water previously displaced, and an immediate drop of the water level within container 371. The now negative buoyancy of the float bucket causes it to descend. Check valve 342 closes and check valve 341 opens, bringing in a new supply of liquid as piston 344 descends.

The Second Cycle

Compressed air from any suitable supply source flowing into conduit 300 encounters pressure-regulating valve 301. The purpose of pressure-regulating valve 301 is to provide a fixed reduced-pressure to the inverted bucket pump assembly. The pressure setting on this regulator will be set slightly above the pressure required to make a submerged inverted bucket buoyant. With a ten inch stroke like that being utilized for the pump illustrated in FIG. 4, a pressure setting of two pounds would be more than adequate. An inverted bucket pump with a stroke of twenty feet would have a regulator setting of about fourteen pounds.

Compressed air leaving the pressure regulator moves through conduit 302 to junction point 303, where it is directed downward to pneumatic blow valve 336 and upward to restrictor valves 307 and 314. Restrictor valve 307 feeds compressed air to the top side of the diaphragm on pneumatic vent valve 350. Restrictor valve 314 feeds compressed air to the top side of the diaphragm on pneumatic blow valve 336. The automatically controlled opening and closing of these two valves 336 and 350 causes the reciprocating action of the inverted bucket 356.

Pressurizing the top side of the diaphragms on these pneumatically operated valves will deflect the diaphragms downward, closing the valve being pressurized.

Air for valve closing is being constantly supplied in limited volume through restrictor valves 307 and 314. Actual valve control is accomplished by providing a total bleed of this limited volume compressed air to the atmosphere when valve opening is desired. Spring pressure assists in opening the valve.

The bleed valve that opens the pneumatic vent valve 350 is valve 322, and this valve is illustrated in the closed position in FIG. 4. The diaphragm of pneumatic vent valve 350 is pressurized and the valve is shut.

Pneumatic blow valve 336 is controlled by two bleed valves in a series configuration, where both must be open to provide a path to the atmosphere for the bleed air. Bleed valves 362 and 327 must both be open to prevent pressurization of the diaphragm on pneumatic blow valve 336. In the illustration of FIG. 4, bleed valve 362 has just closed as a result of the falling of float 370. The diaphragm of pneumatic blow valve 336 is pressurized and valve 336 is shut.

An upward movement of the inverted bucket float 356 also results in an upward movement of the vent control conduit 352 and pneumatic vent valve 350. Flexible hoses on all control air lines allow this movement. Attached to the top side of vent control conduit 352 is a bracket and arm assembly which is lifting round magnet 332 within a non-magnetic guide tube 331. Magnetic attraction is firmly holding, at the bottom of magnet 332, a piece of iron 334, which is also moving upward within the non-magnetic guide tube. Prior to the piston 344 reaching the top of its ten-inch stroke, the upward moving iron 334 reaches non-magnetic shoulder 333, and is forcibly separated from magnet 332. Regardless of the stroke of the inverted bucket pump, the total distance travelled by the magnet would be no more than ten inches, so a suitable reduction gear arrangement would be required on inverted bucket pumps with strokes over ten inches.

The separation of the iron 334 from the magnet 332 by the action of shoulder 333 causes iron 334 to fall down the non-magnetic guide tube 331, where it hits a lever 329, which is pivoted in the center like the common seesaw, and falls to rest on a rubber shock absorber 330. The downward movement of lever 329 lifts a counterweight to the right of pivot point 326, closing bleed valve 327 and opening bleed valve 322. Opening bleed valve 322 bleeds the air pressurizing the diaphragm of pneumatic vent valve 350. It immediately opens allowing compressed air from the inverted bucket float 356 to be released to the atmosphere at opening 351. The bucket immediately fills with water, lifting float 370 and opening bleed valve 362. Bleed valve 327 is now closed and, as these valves are in series, the diaphragm of pneumatic blow valve 336 stays pressurized, keeping this valve shut. The water level in bucket housing 371 drops and bucket 356 begins its descent. The downward travel of the bucket again causes the magnet 332 to reach proximity with the iron 334 and the iron snaps up to the magnet to regain the position shown in illustration in FIG. 4.

Bleed valve 327 is again opened by action of counterweight 324. Float 370 is now in the "up" position, because float bucket 356 is at this time full of liquid. Open bleed valves 362 and 327 release all pressure from the diaphragm of pneumatic blow valve 336, and blowing of the bucket begins. Blowing is terminated when the water level within the bucket reaches a point low enough to cause float 370 to fall. The fall of float 370 closes bleed valves 362 and terminates the blow. The beginning of the delivery cycle starts an upward movement and places all components in the position illustrated by FIG. 4.

The inverted bucket pump driving a gas compressing piston would be provided with a moveable float and valve assembly that would replace float 370 and valve assembly 362. This assembly would be re-located to the interior of float bucket 356 and be moved by a piston responsive to final gas pressure. The reasons for this change are fully covered in the presentation.

FIG. 4 illustrates a preferred embodiment of the inverted bucket pump. The maximum air pressure required to operate this embodiment of the invention is determined by the head of fluid above the bottom edge of the float bucket 356.

The liquid that the float bucket lifts through enters the float chamber by gravity and can be any flowable fluid such as water, oil, or an anti-freeze solution. The float chamber loss will depend on evaporation or spillage and is maintained at a predetermined minimum low level by float 378 and value 385.

The sequence of operation for the pump illustrated in FIG. 4 commences with a supply of air derived from any convenient source through conduit 300 which is coupled via an air pressure regulator 301 to the input air manifold 304 via conduit 302 and T connector 303. Conduit 302 may be a flexible line or a rigid tubular structure.

The air entering manifold 304 is coupled to restrictor valves 307 and 314 by conduits 305 and 312 respectively. Manifold 304 also includes a pneumatically controlled air supply valve 336 which couples air through conduit 373 to float bucket 356.

At the beginning of the cycle, air in manifold 304 is permitted to flow through restrictor valve 307 as a function of the position of control screw 306. This air passes through conduit 308 to the rigid conduit 310 connected to Schraeder type bleed valve 323 and to flexible conduit 309. Flexible conduit 309 is normally in the shape of an elongated and inverted U to permit the air vent assembly including pneumatic valve 350 and associated conduits 352 and 351 to rise up and down with float bucket 356. Flexible conduit 309 is illustrated with a broken segment to indicate the fact that it is longer than illustrated.

Air flowing through conduit 309 enters conduit 311, which is coupled to the pressure dome of pneumatic vent valve 350. When the pressure dome of this pneumatic vent valve is pressurized, the valve closes and the atmospheric vent tube 351 from bucket 356 is closed.

FIG. 4 illustrates the system at the beginning of a delivery cycle, float bucket 356 being at the bottom of chamber 371 as shown. Float 370 is in a horizontal position, indicating that all liquid has been blown from float bucket 356, air supply to conduit 373 has been shut off, and maximum buoyancy of bucket 356 has been attained. A delivery cycle is in progress and no further air will flow through conduit 373 until this delivery cycle is completed.

The downward movement of control float 370 is the triggering action that terminates air flow into the inverted bucket float 356. As previously explained, the inverted bucket pump illustrated in FIG. 4 being is being utilized to make a hydraulic lift, which necessitates maximum buoyancy of bucket float 356 at the beginning of the upward or discharge stroke. Bleed control float 370 is appropriately attached to the bottom edge of the inverted bucket 356, so that it will not drop unless all liquid is blow from the bucket float 356.

Float 370 is supported by a hinge member 369 coupled to a mounting flange 368 secured to the lower edge of float bucket 356. Liquid filling float bucket 356 causes an upward movement of float 370 and cam arm 367 is rotated against push rod 365, sliding it through bushing 366 and causing valve disc 363 to be pushed off of the valve seat 364, compressing spring 361. This opens bleed valve 362 and provides a passage for bleed air through conduit 357 to conduit 358, and to the atmosphere through bleed valve 327. FIG. 4 shows control float 370 has just dropped to the horizontal position, closing valve disc 363, and bleed air passage through valve 362 is no longer open. Supply air to conduit 373 has been terminated by the pressure build-up on the top side of the diaphragm on pneumatic blow valve 336.

Liquid displaced from the interior of inverted bucket 356 by the previously incoming compressed gas has been blown downward and into the float bucket chamber 371. The surface of the liquid within chamber 371 is open to the atmosphere through open vent port 375. The up and down movement of the liquid surface within chamber 371 is directly related to the liquid level existing within inverted bucket 356 and is shown in FIG. 4 at its highest elevation as a consequence of recent complete blow of inverted bucket 356. Maximum buoyancy of the inverted bucket float 356 now exists and no additional air is needed for the completion of the delivery stroke of piston 344.

A minimum liquid level is maintained within the float bucket chamber 371 by the action of float 378, which will only fall to replace liquid lost through evaporation or spillage. Float 378 controls the seating of valve body 385 into valve seat 386. Float 378 is connected to a bracked 381 via a hinge-pin 380 and a horizontal arm 379. The horizontal arm acts on a rigidly attached vertical arm, which includes a second hinge means 382 that supports valve support rod 384 in a manner so that when the liquid level within the chambers 377 and 371 reaches a predetermined level, valve body 385 is driven firmly into seat 386, but when the level of liquid in the chambers 377 and 371 falls below an adjusted minimum level, replenishment liquid is permitted to flow by gravity through conduit 387 from any suitable source. Control chamber 377 is a relatively small chamber and is sealed about an opening in chamber 371 by flange means 376, which completely encircles the abutting surface of the small control chamber 377.

Inverted float bucket 356 is firmly attached to the under side of piston 344 by means of hollow shaft 346. A loose-fitting guide bushing 347 ensures that the piston is driven in a smooth and straight manner into the pump cylinder 343. Holes (not shown) drilled vertically in the bushing prevent hydraulic lock. A piston ring is provided about the outer periphery of piston 344 to prevent leakage of any gas or liquid above the piston into the chamber below.

An inlet port is located on the left side of pump cylinder 343. This inlet port is fitted with a one-way check valve 341, which will allow any gas or liquid coupled to the valve via conduit 339 to enter the pump cylinder, but will prevent gas or liquid from being driven back out. An exit port is provided at the top of the cylinder and it is provided with a one-way check valve 342 which will allow gas or liquid to escape from the cylinder as the piston moves upward. Gas or liquid flowing through the one-way check valve 342 is coupled via conduit 340 to any desired destination.

Float bucket 356 making an ascent through the liquid contained within float chamber 371 forces pump piston 344 upward and also carries conduit 352 upward, which is secured to hollow shaft 346 at bushing 354. As conduit 352 rises, the upper portion of the air vent system, including conduit 351, is also caused to raise. A bracket 348 secured to conduit 351 causes the rigidly affixed support arm 318 to raise with conduit 351. As support arm 318 raises, magnet 332 is drawn upward through linkage 320 which is pinned at 317 and 319 between the horizontal support arm 318 and the magnetic body 332. When magnet 332 raises, iron mass 334 is drawn upward through the non-magnetic guide tube 331. When the float bucket has reached a position near the top of the piston stroke, the lower end of magnet 332 enters the restricted portion 333 at the top of the non-magnetic guide tube 331. The shoulder of restricted portion 333 causes a separation between magnet 332 and iron mass 334 which is at a distance great enough to cause the magnet to lose its control over the iron mass. The iron mass is released and it drops to the bottom of guide tube 331 where it drives lever arm 329 down against the rubber cushion 330. Lever arm 329 is pivotally supported at 326 so that it will raise mass 324 and allow bleed valve 327 to close and, at almost the same instant, force bleed valve 322 open by the upward movement of lever arm 325 pressing on bleed valve stem 323.

Release of bleed air from around valve stem 323 causes an immediate drop of pressure in the pressure dome of pneumatic vent valve 350 which allows the valve to open and air within the inverted bucket float 356 to vent to the atmosphere, via hollow shaft 346, conduit 355, conduit 352 and conduit 351. As the air is allowed to vent from inverted bucket float 356, the bucket sinks as a function of the bucket weight and the weight of attachments.

The sinking of the inverted bucket float 356 pulls piston 344 down, causing an intake stroke of the pump and drawing a new supply of liquid or gas through check valve 341. The venting of compressed air from the float bucket 356 caused it to refill with the liquid contained in chamber 371 and float 370 was lifted by this surge of incoming liquid. Float 370 being lifted did not start a new blow cycle as valve 327 remained closed due to the iron mass 334 remaining at rest on rubber pad 330. A full sinking of the bucket 356 again brings magnet 332 into proximity with iron mass 334 and iron mass 334 snaps to its illustrated position and another blow is started as a result of the opening of bleed valve 327. The blow is terminated by the falling of float 370 and a new delivery cycle is started.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim and for which I desire Letters Patent is:

1. A method of extracting energy from a non-surging fluid source of potential energy, including the steps of:

permitting fluid from said non-surging source to enter a container;

venting into a pressurized gas system gas displaced by said fluid entering said container; and draining said fluid from said container via pneumatic valve means controlled by pilot valve means responsive to fluid displaced magnetic means while permitting a fresh charge of gas to enter said container.

2. A method of extracting energy from a non-surging fluid source of potential energy as defined in claim 1, including the steps of:

transporting said pressurized gas to a remote site; and extracting useful work from the potential energy stored in said pressurized gas.

3. A method of extracting energy from a non-surging fluid source of potential energy, including the steps of:

permitting fluid from a non-surging source to enter a container in response to a pneumatic signal indicative of a relative absence of fluid in said container;

venting into a pressurized gas duct system gas displaced by said fluid entering said container; and draining said fluid from said container via pneumatic valve means controlled by pilot valve means responsive to fluid displaced magnetic means while permitting a fresh charge of gas to enter said container in response to a signal indicative of the fluid level in said container reaching said predetermined value.

4. An apparatus for extracting energy from a non-surging fluid source of potential energy, comprising:

a container;

control means to admit fluid from said source into said container;

vent means to allow gas displaced by said fluid in said container to exit said container as compressed gas;

drain control means responsive to said fluid entering said container and reaching a predetermined volume for closing said means to admit said fluid;

said drain control means including, a pneumatic valve, a pilot valve for controlling said pneumatic valve, a pilot valve actuator including a lever arm supporting a magnetic mass, a non-ferrous tube positioned adjacent to said lever arm, a ferrous mass adapted to move within said non-ferrous tube as a function of the fluid level in said container;

drain means responsive to said drain control means for permitting said fluid to drain from said container;

vent means to permit a fresh charge of gas to enter said container as said fluid drains from said container;

fill control means responsive to the removal of said fluid from said container; and means responsive to said fill control means for closing said drain means and opening said control means to admit fluid from said source into said container.

5. An apparatus for extracting energy from a non-surging fluid source of potential energy as defined in claim 4, further comprising:

a chamber;

means to admit a fluid into said chamber;

exhaust means to permit gas displaced by said fluid entering said chamber to escape from said chamber;

exhaust control means responsive to fluid in said chamber reaching a predetermined volume;

said exhaust control means including, a pneumatic valve, a pilot valve for controlling said pneumatic valve, a pilot valve actuator including a lever arm supporting a magnetic mass, a non-ferrous tube positioned adjacent to said lever arm, a ferrous mass adapted to move within said non-ferrous tube as a function of the fluid level in said container;

means responsive to said exhaust control means for closing said exhaust means;

blow control means responsive to said pressurized gas extracted from said container;

gas inlet means responsive to said flow control means for admitting said gas to said chamber to force said fluid contained therein from said chamber;

fluid exit means for permitting one-way passage of fluid from said chamber;

cycle complete means responsive to said fluid being expelled from said chamber for closing said gas inlet means; and blow complete means responsive to closure of said gas inlet means for opening said vent means.

6. An apparatus for extracting energy from a non-surging fluid source of potential energy as defined in claim 4, further comprising conduit means coupled to said vent means for transporting said compressed gas to a remotely located compressed gas operated apparatus.

7. An apparatus for extracting energy from a non-surging source of potential energy, comprising:

a chamber;

means to admit a fluid into said chamber;

exhaust means to permit gas displaced by said fluid entering said chamber to escape from said chamber;

exhaust control means responsive to fluid in said chamber reaching a predetermined volume;

said exhaust control means including, a pneumatic valve, a pilot valve for controlling said pneumatic valve, a pilot valve actuator including a lever arm supporting a magnetic mass, a non-ferrous tube positioned adjacent to said lever arm, a ferrous mass adapted to move within said non-ferrous tube as a function of the fluid level in said container;

means responsive to said exhaust control means for closing said exhaust means;

a source of pressurized gas; blow control means responsive to said pressurized gas;

gas inlet means responsive to said blow control means for admitting said gas to said chamber to force said fluid contained therein from said chamber;

fluid exit means for permitting one-way passage of fluid from said chamber;

cycle complete means responsive to said fluid being expelled from said chamber for closing said gas inlet means; and blow complete means responsive to closure of said gas inlet means for opening said vent means.

8. An apparatus for extracting energy from a non-surging source of potential energy, comprising:

a float chamber containing a predetermined quantity of liquid;

a compression cylinder supported by said float chamber;

a float bucket within said float chamber;

a piston within said compression cylinder;

means coupling said piston to said float bucket whereby said piston reciprocates within said compression cylinder as a function of the buoyancy of said float bucket;

one-way inlet valve means in said compression cylinder for permitting fluid to enter said compression cylinder;

one-way outlet valve means for permitting fluid to leave said compression cylinder;

said inlet valve means and said outlet valve means connected to the same end of said compression cylinder;

float bucket vent means for permitting gas to escape from said float bucket;

a source of pressurized gas;

float bucket pressurization means for admitting compressed gas to said float bucket;

float bucket vent control means responsive to said pressurized gas for closing said float bucket vent means;

float bucket pressurization control means responsive to said pressurized gas for closing said float bucket pressurization means;

means responsive to said float bucket containing a quantity of liquid causing it to have negative buoyancy to vent said pressurized gas from said float bucket pressurization control means to permit said float bucket pressurization means to open;

means responsive to said float bucket rising to a predetermined level in said float chamber for venting said float bucket vent control means to open said float bucket vent whereby said gas within said float bucket may escape; and said float bucket vent means and said float bucket pressurization means open and close in a mutually exclusive manner.

9. An apparatus for extracting energy from a nonsurging source of potential energy as defined in claim 8, wherein said float chamber is suspended in a body of liquid.

10. An apparatus for extracting energy from a nonsurging fluid source of potential energy, comprising:

a chamber;

means to admit a fluid into said chamber;

exhaust means to permit gas displaced by said fluid entering said chamber to escape from said chamber;

exhaust control means responsive to fluid in said chamber reaching a predetermined volume;

means responsive to said exhaust control means for closing said exhaust means;

a source of pressurized gas;

blow control means responsive to said pressurized gas;

gas inlet means responsive to said blow control means for admitting said gas to said chamber to force said fluid contained therein from said chamber;

fluid exit means for permitting one-way passage of fluid from said chamber;

cycle complete means responsive to said fluid being expelled from said chamber for closing said gas inlet means;

blow complete means responsive to closure of said gas inlet means for opening said vent means;

a float chamber containing a predetermined quantity of liquid;

a compression cylinder supported by said float chamber;

a float bucket within said float chamber;

a piston within said compression cylinder;

means coupling said piston to said float bucket whereby said piston reciprocates within said compression cylinder as a function of the buoyancy of said float bucket;

one-way inlet valve means in said compression cylinder for permitting fluid to enter said compression cylinder;

one-way outlet valve means for permitting fluid to leave said compression cylinder;

said inlet valve means and said outlet valve means connected to the same end of said compression cylinder;

float bucket vent means for permitting gas to escape from said float bucket;

a source of compressed gas derived from said exhaust means;

float bucket pressurization means for admitting compressed gas to said float bucket;

float bucket pressurization means for admitting compressed gas to said float bucket;

float bucket vent control means responsive to said pressurized gas for closing said float bucket vent means;

float bucket pressurization control means responsive to said pressurized gas for closing said float bucket pressurization means;

means responsive to said float bucket containing a quantity of liquid causing it to have negative buoyancy to vent said pressurized gas from said float bucket pressurization control means to permit said float bucket pressurization means to open;

means responsive to said float bucket rising to a predetermined level in said float chamber for venting said float bucket vent control means to open said float bucket vent whereby said gas within said float bucket may escape; and said float bucket vent means and said float bucket pressurization means open and close in a mutually exclusive manner.

11. An apparatus for extracting energy from a nonsurging fluid source of potential energy as defined in claim 10, further comprising a gas storage chamber incorporated in said compressed gas conduit, said gas storage chamber having a capacity greater in magnitude than said container by a factor greater than 100.

* * * * *